United States Patent [19]

Ikeda

[11] Patent Number: 5,072,259

[45] Date of Patent: Dec. 10, 1991

[54] IMAGE FORMING APPARATUS HAVING MAGNIFICATION CAPABILITIES WITH CHARGE REMOVAL OUTSIDE IMAGE AREA

[75] Inventor: Yoshinori Ikeda, Matsudo, Japan

[73] Assignee: Canon Kabushiki Kaisha, Tokyo, Japan

[21] Appl. No.: 532,227

[22] Filed: Jun. 5, 1990

Related U.S. Application Data

[63] Continuation of Ser. No. 201,308, May 31, 1988, abandoned, which is a continuation of Ser. No. 922,176, Oct. 23, 1986, abandoned, which is a continuation of Ser. No. 550,634, Nov. 10, 1983, abandoned.

[30] Foreign Application Priority Data

Nov. 20, 1982 [JP] Japan ..... 57-203989
Sep. 13, 1983 [JP] Japan ..... 58-170387

[51] Int. Cl.[5] ..... G03G 15/04

[52] U.S. Cl. ..... 355/218; 355/243; 355/311

[58] Field of Search ..... 355/218, 243, 311, 55–57

[56] References Cited

U.S. PATENT DOCUMENTS

| | | | |
|---|---|---|---|
| 3,689,143 | 9/1972 | Case et al. | 355/243 |
| 3,834,807 | 9/1974 | Fuller et al. | 355/218 |
| 3,912,387 | 10/1975 | Brooke | 355/14 RY |
| 3,967,896 | 7/1976 | Looney et al. | 355/14 R |
| 3,994,723 | 11/1976 | Brooke | 430/30 |
| 4,173,406 | 11/1979 | Oyama et al. | 355/218 |
| 4,236,811 | 12/1980 | Hirose et al. | 355/218 |
| 4,338,020 | 7/1982 | Yukawa et al. | 355/311 X |
| 4,384,785 | 5/1983 | Katoh et al. | 355/14 E |
| 4,474,453 | 10/1984 | Yanagawa et al. | 355/14 RY |
| 4,582,417 | 4/1986 | Yagasaki et al. | 355/7 |

FOREIGN PATENT DOCUMENTS

| | | |
|---|---|---|
| 0016923 | 10/1980 | European Pat. Off. . |
| 2505833 | 8/1975 | Fed. Rep. of Germany . |
| 2856596 | 7/1979 | Fed. Rep. of Germany . |
| 52-155552 | 11/1977 | Japan . |
| 54-126041 | 9/1979 | Japan . |
| 56-59277 | 5/1981 | Japan . |
| 2011647 | 11/1979 | United Kingdom . |

OTHER PUBLICATIONS

*IBM Technical Disclosure Bulletin,* vol. 19, No. 2, Jul. 1976, Underhill, "Erase Lamp Control", pp. 393–394, 355/7.

*Primary Examiner*—Joan H. Pendegrass
*Attorney, Agent, or Firm*—Fitzpatrick, Cella, Harper & Scinto

[57] ABSTRACT

An image forming apparatus has as control unit which controls an image formation area on a photosensitive drum in accordance with original document size information detected by an original document size detector and magnification/reduction scale determined by a selected magnification/reduction mode. Unnecessary area other than a desired image formation area is discharged.

8 Claims, 30 Drawing Sheets

| | MS1 | MS2 | MS3 |
|---|---|---|---|
| A 3 | ON | ON | ON |
| A 4 | ON | OFF | ON |
| B 4 | OFF | OFF | ON |

| ORIGINAL DOC. SIZE | CASSETTE SIZE | MODE |
|---|---|---|
| A3 | A4 | A3→A4(REDUCTION 2) |
| A3 | B4 | A3→B4(REDUCTION 1) |
| A4 | A3 | X |
| A4 | B4 | X |
| B4 | A3 | X |
| B4 | A4 | B4→A4(REDUCTION 1) |

| ORIGINAL DOC. SIZE / MODE | A3 | B4 | A4 |
|---|---|---|---|
| REAL SIZE | 1 | 5 | 9 |
| A3→B4 | 2 | 6 | 10 |
| B4→A4 | 3 | 7 | 11 |
| A3→A4 | 4 | 8 | 12 |

DYNAMIC LIGHTING TIMING CHART

IMAGE FORMING APPARATUS HAVING MAGNIFICATION CAPABILITIES WITH CHARGE REMOVAL OUTSIDE IMAGE AREA

This application is a continuation of application Ser. No. 07/201,308 filed May 31, 1988, now abandoned, which was a continuation of application Ser. No. 06/922,176, filed Oct. 23, 1986, now abandoned, which was a continuation of application Ser. No. 06/550,634, filed Nov. 10, 1983, now abandoned.

BACKGROUND OF THE INVENTION

1. Field of the Invention

The present invention relates to an image forming apparatus, and more particularly to an image forming apparatus for forming a latent image on a photosensitive material by an optical image from an illuminated original document.

2. Description of the Prior Art

In a conventional copying machine, a photosensitive drum having a photosensitive material such as a photosensitive layer on a surface thereon on which a latent image is to be formed has an entire area of the surface uniformly charged prior to the illumination by an optical image for the latent image formation. However, since a width of the photosensitive drum is wider than a width of a copy paper of a maximum possible copy size, when a copy paper of other than the maximum size is set or even when the copy paper of the maximum size is set, an area other than that corresponding to the copy paper on the photosensitive drum is charged. Thus, in the past, such a charge is eliminated prior to the development of the latent image in accordance with the size of the copy paper to prevent developing agent from being deposited to such area so that waste of the developing agent and scatter of the developing agent in the apparatus are prevented. However, if an original document of a size A4 is to be copied in the copying machine in which the copy papers of a size A3 are set, the waste and the scatter of the developing agent are prevented by discharging the unnecessary area in accordance with the size of the copy paper, nevertheless, dirt on an original document cover for fixing the original document, and dirt on a belt for conveying the original document to an exposure station, are copied on that area of the size A3 copy paper which does not correspond to the size A4 original document, as a result, a copied image is dirty.

SUMMARY OF THE INVENTION

It is an object of the present invention to provide an image forming apparatus which prevents waste and scatter of developing agent and eliminates unnecessary imaging other than an original image.

It is another object of the present invention to provide an image forming apparatus which controls an image forming area on a photosensitive material in accordance with size information of an original document to be copied and copy magnification factor information.

It is other object of the present invention to provide an image forming apparatus which suppresses formation of wasteful image portions in areas other than an image forming area.

It is a further object of the present invention to provide an image forming apparatus which controls a desired image forming area.

In one aspect of the invention, an image forming apparatus is provided with means for specifying an image formation mode, area discrimination means for discriminating an image formation area in accordance with a signal from the specifying means, and area control means for removing an image beyond the image formation areas based on the information from the area discrimination means, wherein the area control means includes discharging lamps.

DETAILED DESCRIPTION OF THE PREFERRED EMBODIMENTS

Figure 1:
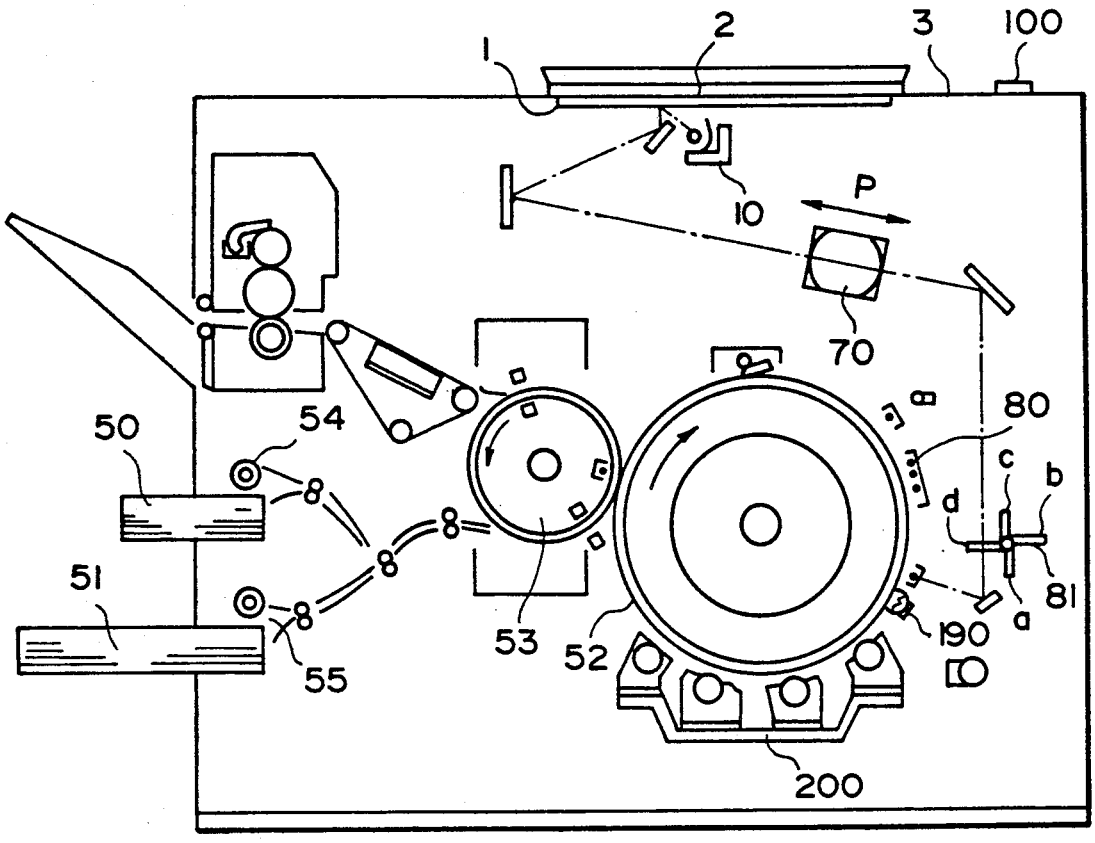
FIG. 1 shows a construction of a color copying machine.

FIG. 1 shows a color copying machine which is an example of an image forming apparatus to which the present invention is applied.

An entire surface of a photosensitive drum 52 is charged by a charger 80 and then electrostatic latent images for respective colors are formed on the photosensitive drum or medium 52 by an image of an original document through blue, green and red filters 81 (*a, b, c, d*). The latent images are then developed by a developing unit 200 by toners of colors corresponding to the colors of the filters 81, that is, yellow toner for the blue filter, magenta toner for the green filter and cyan toner by the red filter, and the developed images are sequentially transferred to a transfer drum 53 in superposition on each other to form a color image.

Elements related to the present invention are selection means for cassettes 50 and 51 associated with paper feed rollers 54 and 55, original document size sense means located at an original document cover 2 and an original document illumination scan table 10, magnification factor varying means by position control of a lens 70 which is bilaterally movable in a direction of P, a control panel 100 which is input means by an operator, a microcomputer (not shown) which is control means, and a discharging lamp array 190. Those elements will now be explained in sequence.

It is assumed that the cassettes 50 and 51 loaded into the copying machine can accommodate copy papers of three different sizes, A3, B4 and A4.

One of the cassettes 50 and 51 which is to feed the papers is selected by selectively actuating one of the paper feed rollers 54 and 55. The selection is made by the microcomputer to be described later.

Figure 2:
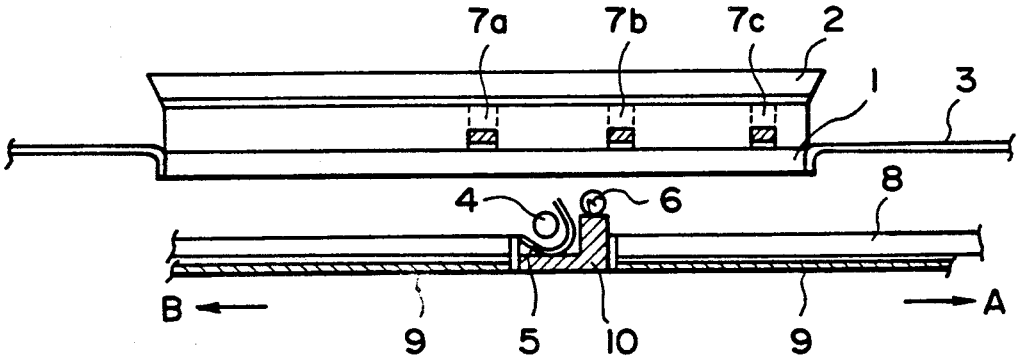
FIG. 2 shows original document size sensor.

The original document size sense means is disposed in an original document illumination scan system shown in FIG. 2. The original document illumination scan system comprises a platen glass 1 which is attached to an upper frame 3 of the copying machine and on which the original document is to be mounted, the original document cover 2 which covers the mounted original document, an original document illumination lamp 4 for illuminating the original document and the original document illumination scan table having a reflection illumination scan table 10 is movably mounted on a rail 8 arranged substantially parallel to the platen glass 1 and it is moved in a direction of A or B when it is pulled by a wire 9 so that the mounted original document is scanned by the original document illumination lamp 4.

The original document size sense means comprises CDS photosensors *7a*, *7b* and *7c* arranged on the original document cover 2 and a detection lamp 6 mounted on the original document illumination scan table 10.

Figure 3:
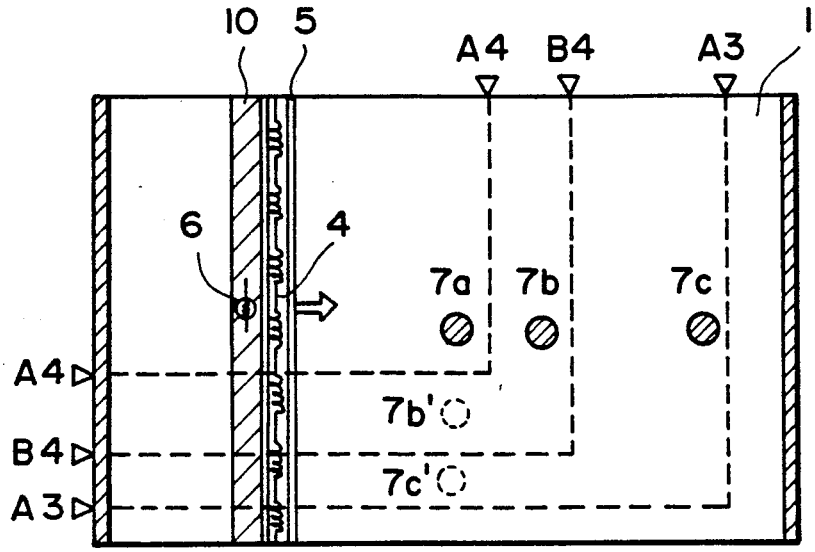
FIG. 3 shows an arrangement of a photosensor.

As shown in FIG. 3, the photosensors *7a*, *7b* and *7c* are arranged such that when the original document is mounted at a reference position on the platen glass 1 and the original document cover is contacted thereto, the photosensors *7a*, *7b* and *7c* are located at positions slightly inward of ends of the original documents of the sizes A4, B4 and A3, respectively. The photosensors *7a*, *7b* and *7c* are also arranged in a line along a moving path of the detection lamp 6.

The photosensors *7a*, *7b* and *7c* produce outputs when they receive a light from the detection lamp 6 which is moved therebelow. When the original document is present between the photosensor and the detection lamp, the light from the detection lamp 6 is intercepted by the original document and the photosensor does not produce the output.

Figure 4:
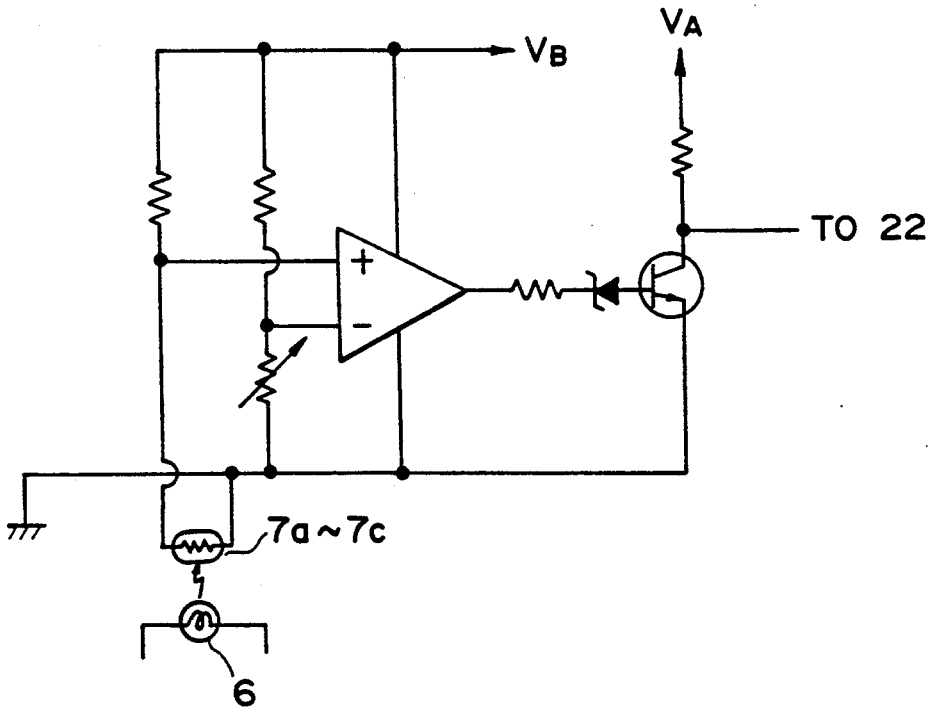
FIG. 4 shows a photo-detection circuit.

The photosensor *7a*, *7b* or *7c* is connected to a positive input terminal of a comparator of a photo-detection circuit shown in FIG. 4. The outputs of the photosensors *7a*, *7b* and *7c* are converted to original document size detection signals shown in FIGS. 5 (*a*)–(*d*) by the comparator, a zener diode and a transistor shown in FIG. 4. Numeral 22 denotes an input bus to be described later.

Figure 5:
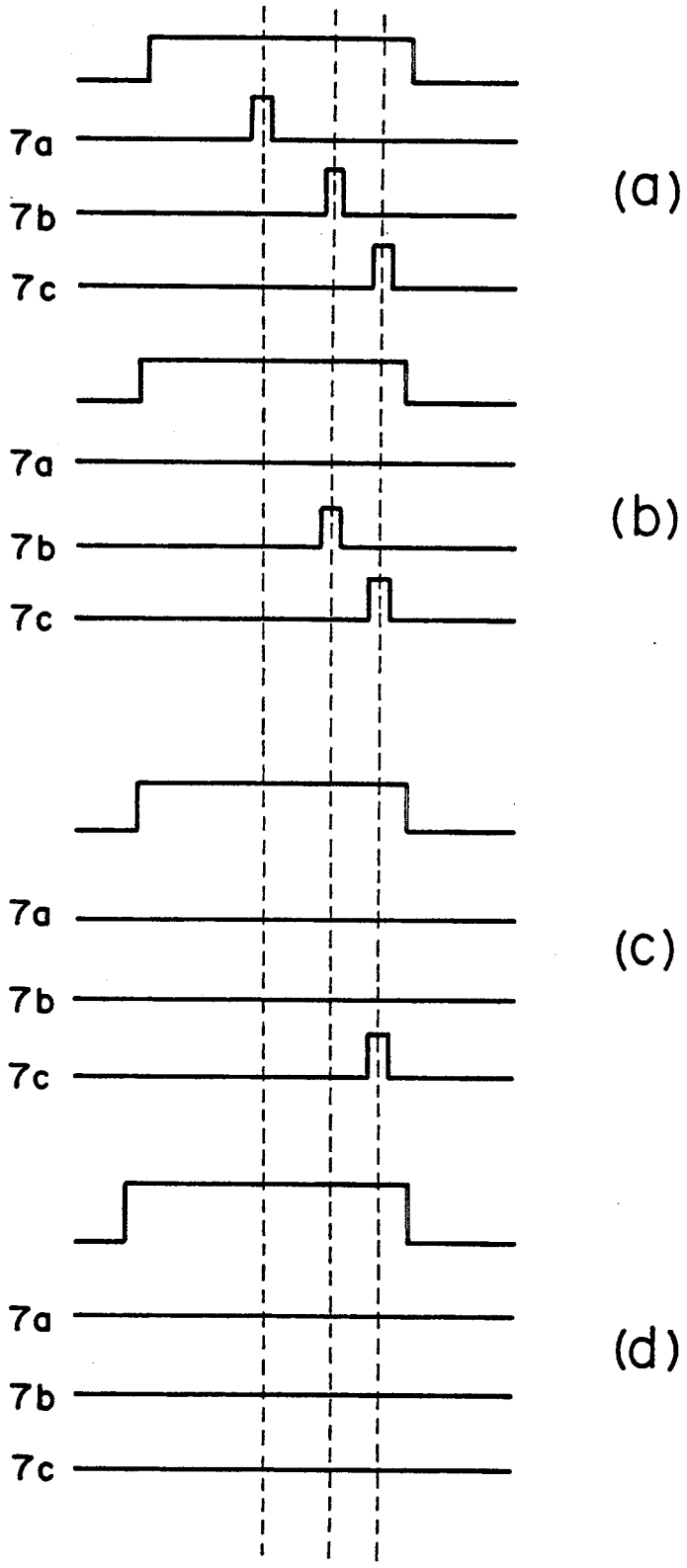
FIGS. 5 (*a*)–(*d*) shows an original document size detection signal.

FIGS. 5(*a*)–5(*d*) show timings of the output signals of the photo-detection circuit in accordance with the respective sizes of the mounted original documents. The top waveforms of the respective figures show advance signals of the scan table 10 from a microcomputer to be described later. They show the timings of the output signals of the photo-detection circuit after the detection lamp 6 on the scan table 10 has scanned a complete scan width. FIG. 5(*a*) shows the waveforms when no original document is mounted. Since there is nothing to intercept the light from the detection lamp 6, all photosensors *7a*, *7b* and *7c* produce the outputs and the photo-detection circuit produces three high level signals FIG. 5(*b*) shows the waveforms when the mounted original document is of size A4. The photosensor *7a* does not produce the output because the light thereto is intercepted by the original document, but the photosensors *7b* and *7c* produce the outputs because the light thereto is not intercepted so that the photo-detection circuit produces two high level signals. FIG. 5(*c*) shows the waveforms when the mounted original document is of size B4. The photosensors *7a* and *7b* do not produce the output because the light thereto is intercepted while the photosensor *7c* receives the light so that the photo-detection circuit produces one high level signal. FIG. 5(*d*) shows the waveforms when the mounted original document is of size A3. All of the photosensors *7a*, *7b* and *7c* do not produce the output because the light thereto is intercepted and the photo-detection circuit does not produce the output signal.

Since the output terminal of the photo-detection circuit, that is, a collector terminal of the transistor is connected to an I/O port of the microcomputer, the output signal of the photo-detection circuit is supplied to the microcomputer and decoded thereby so that the size of the mounted original document is detected.

The cassette size detection means of the copying machine is now explained with reference to FIGS. 6 and 7.

Figures 6, 7:
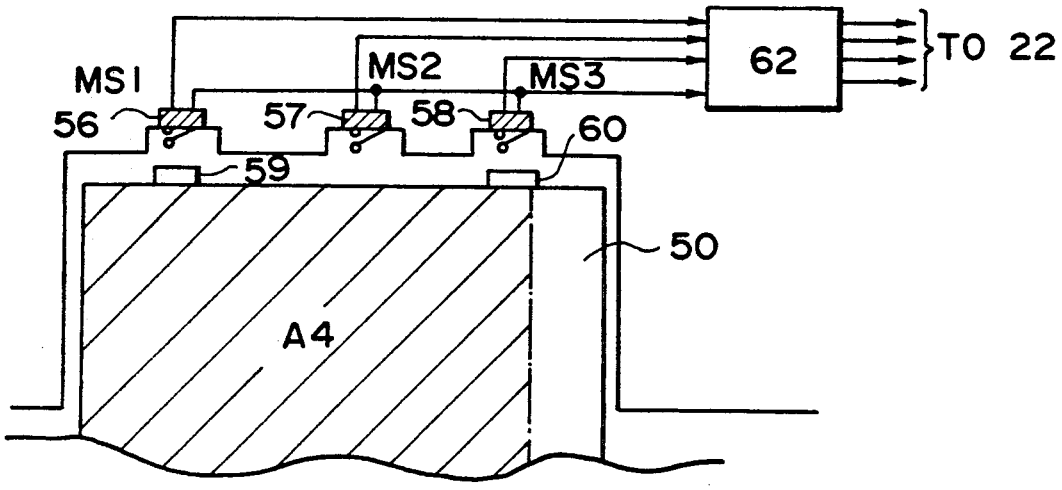
FIG. 6 shows a cassette size sensor.
FIG. 7 shows a relation between a cassette size and a microswitch.

As shown in FIG. 6, recesses 56, 57 and 58 are formed at the innermost region of a cassette mount of the copying machine, and microswitches MS1, MS2 and MS3 are associated therewith, respectively. The microswitches MS1, MS2 and MS3 are connected to an interface circuit 62 which produces signals as the switches are turned on and off. Numeral 22 denotes the input bus.

A front side of each cassette has projections formed thereon which engage with the selected ones of the recesses 56, 57 and 58 when the cassette is loaded. For example, the size A4 cassette 50 shown has the projections 59 and 60 which engage with the recesses 56 and 58 when the cassette is loaded so that the microswitches MS1 and MS3 are turned on.

The size A3 cassette has three projections which actuate the microswitches MS1, MS2 and MS3, and the size B4 cassette has one projection which actuates only the microswitch MS3.

The turn-on and turn-off conditions of the microswitches MS1, MS2 and MS3 when the cassettes of the respective sizes are loaded are shown in FIG. 7. The interface circuit produces the output signals depending on the turn-on and turn-off conditions. The interface circuit is connected to the microcomputer through the input bus 22. The signal from the interface circuit is supplied to the microcomputer and decoded thereby so that the cassette size of the loaded cassette is detected.

Figure 8:
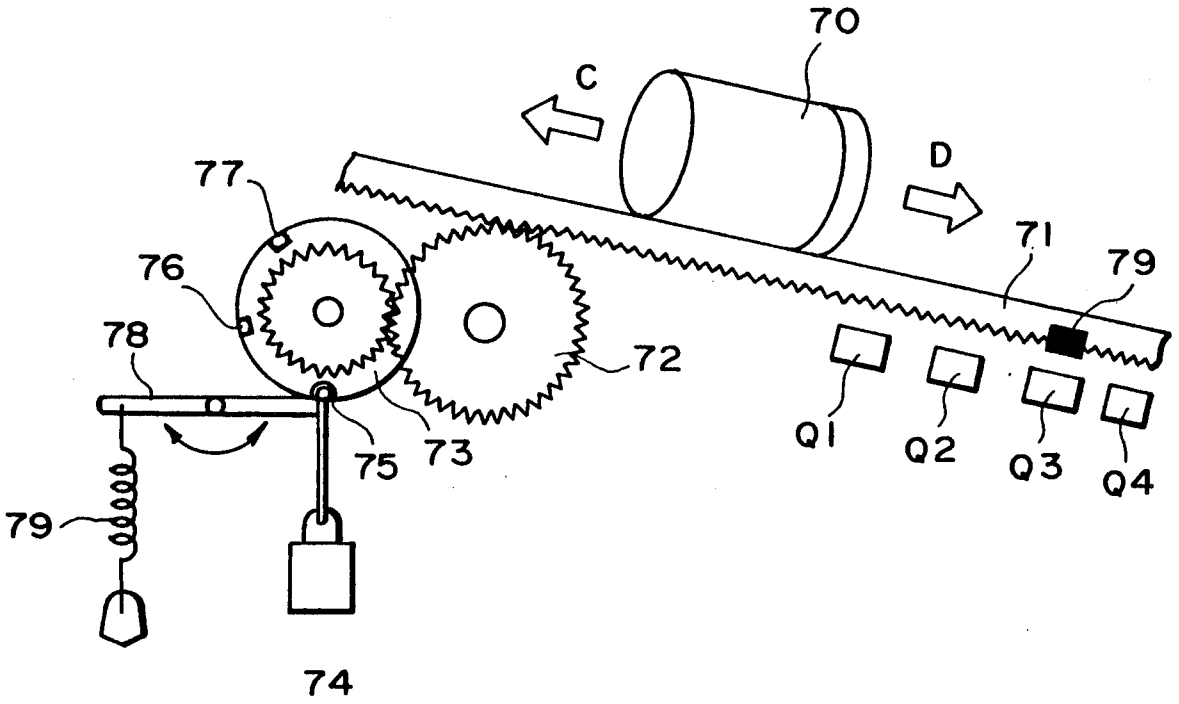
FIG. 8 shows a magnification factor varying mechanism.

The magnification factor varying mechanism is now explained with reference to FIG. 8. A lens 70 which focuses an image of the original document on the photosensitive drum 52 is mounted on a support 71 which meshes with a drive gear 72 driven by a drive motor, not shown and is movable in directions of C and D through the drive by the drive gear 72. Thus, the magnification/reduction scale of the image to be copied is varied as the position of the lens 7 is varied.

Three photo-interrupters Q1, Q2 and Q3 which produce outputs when the lights thereto are interrupted are arranged along the movement path of the support 71. A detection plate 79 which interrupts one of the photo-interrupters Q1, Q2 and Q3 as the support 71 is moved is mounted on the support 71. The position of the lens 70 is detected by the interrupters and the detection plate.

The drive gear 72 meshes with a gear which is coaxially fixed to a disc 73 having three notches 75, 76 and 77 formed on a circumference thereof. A lock rod 78 is mounted on the circumference of the disc 73 and it engages with and disengages from the notches 75, 76 and 77 through a spring 79 and a solenoid 74 to lock and unlock the rotational position of the disc. Thus, the position of the lens 70 is locked and unlocked to a desired magnification/reduction mode position.

The step positions of the disc 73, that is, the lock positions of the lens 70 by the engagement of the lock rod 78 with the notches 75, 76 and 77, respectively, correspond to the detection positions of the photo-interrupters Q1, Q2 and Q3 by the detection plate 79.

Figures 9, 10:
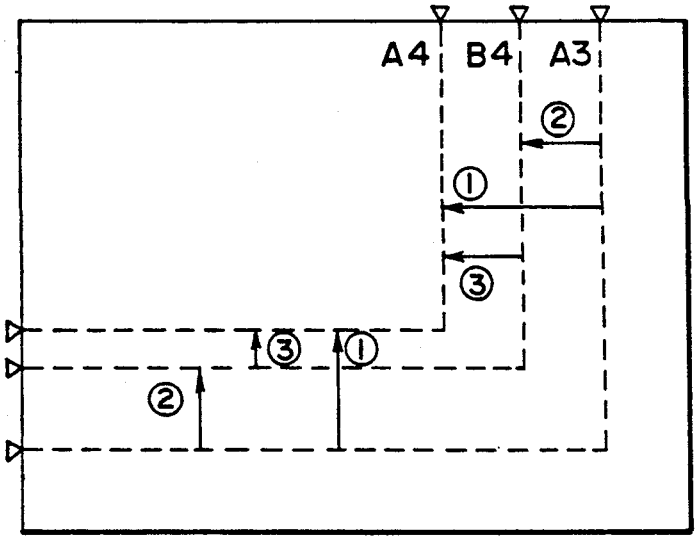
FIG. 9 shows magnification/reduction on a platen.
FIG. 10 shows a relation among an original document size, a cassette size and a mode.

At the position where the photo-interrupter Q1 is detected, the magnification/reduction mechanism is in a unity scale (of real size) mode, and at the position where photo-interrupter Q2 is detected, the mechanism is in a reduction 1 mode as shown by arrows M2 and M3 in FIG. 9, that is, in a reduction mode from the size A3 original document to the size B4 copy paper or from the size B4 original document to the size A3 copy paper shown in FIG. 10. At the position where the photo-interrupter Q3 is detected, the mechanism is in a reduction 2 mode shown by an arrow M1 in FIG. 9, that is, in a reduction mode of from the size A3 original document to the size B4 copy paper shown in FIG. 10.

In the present embodiment, magnifications of A4→A3→A4→B4 and B4→A3 shown by X in FIG. 10 are not carried out.

The photo-interrupters Q1, Q2 and Q3 and a solenoid 74 are connected to the microcomputer through a load drive circuit to be described later so that the microcomputer controls the magnification/reduction mechanism through the solenoid 74 in accordance with the detection signals of the photo-interrupters Q1, Q2 and Q3. The magnification/reduction mechanism may be of a zooming type.

Figure 11:
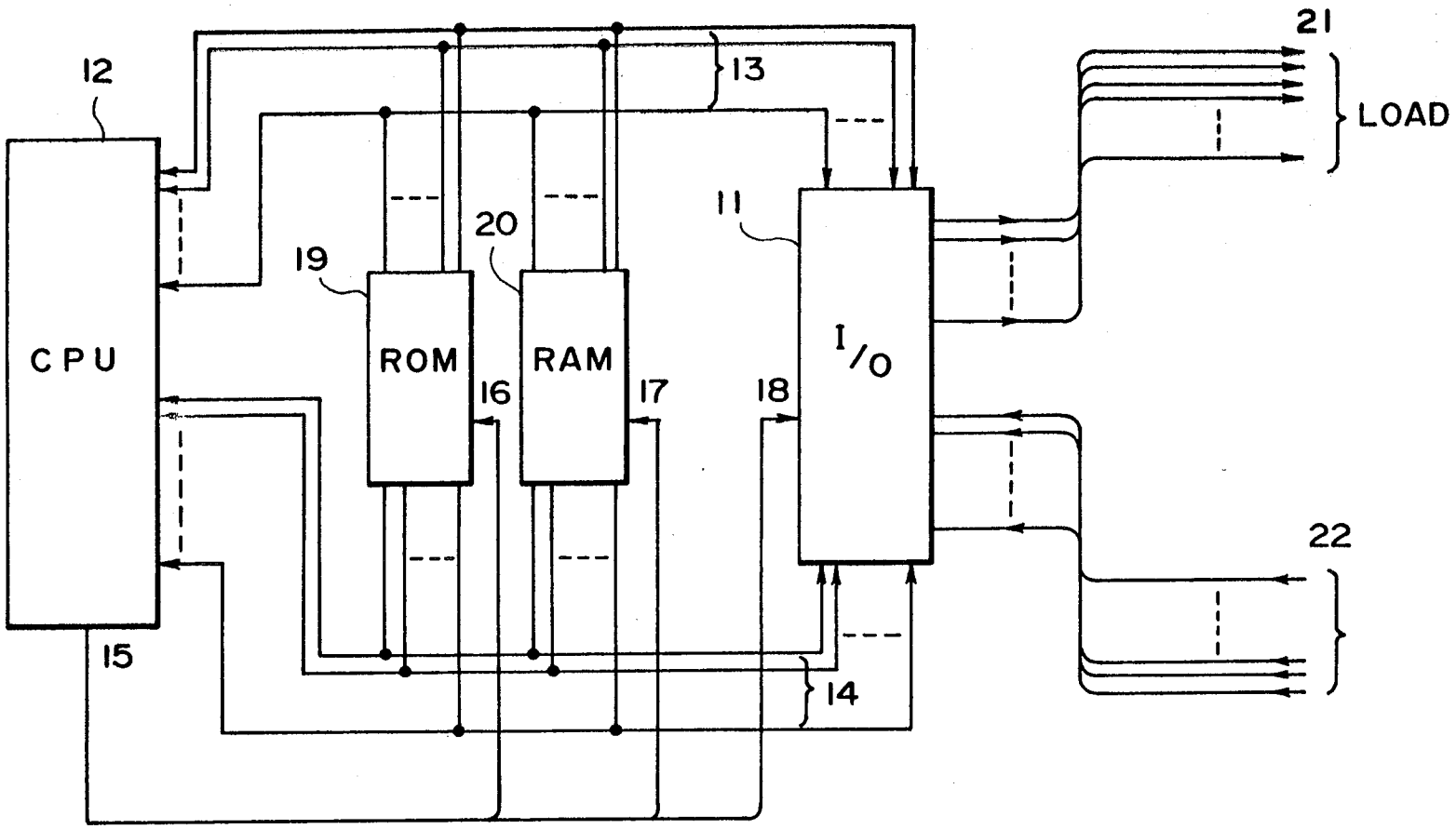
FIG. 11 shows a configuration of a microcomputer.

The configuration of the microcomputer which controls the whole copying machine is now explained with reference to FIG. 11.

The microcomputer comprises a CPU 12 which controls an entire system by processing various signals, and a ROM 19 which contains a system control program, a RAM 20 and an I/O port 11, which are connected to the CPU 12 through data busses 13 and 14.

The loads of the copying machine, such as the original document illumination lamp 4 of the original document illumination scan system, the detection lamp 6, lamps buried in keys on a control panel to be described later and a discharging lamp array, are connected to the I/O port 11 through a load control circuit shown in FIG. 12.

Figure 12:
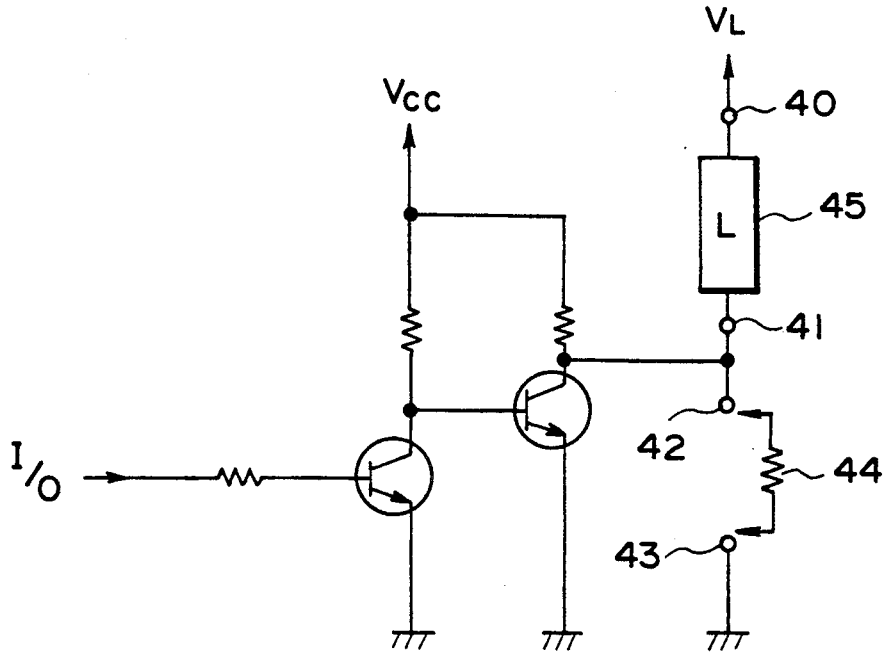
FIG. 12 shows a load control circuit.

The load control circuit of FIG. 12 is for the original document illumination lamp 4 and the detection lamp 6, and it comprises an amplifying transistor having a base thereof connected to the I/O port 11 of the microcomputer through an output bus 21 and a switching transistor having a base thereof connected to a collector of the amplifying transistor. The original document illumination lamp 4 is connected across output terminals 40 and 41 of the load control circuit through an original document illumination turn-on circuit, not shown, and the original document detection lamp 6 is connected across terminals 40 and 41 with a resistor 44 being connected across the output terminals 42 and 43. The resistor 44 may not be inserted depending on the load.

The original document illumination lamp 4 and the original document detection lamp 6 are driven by a signal supplied from the output bus 21 to the load circuit through the I/O port 11 and a signal on the data bus 13 synchronized with timing signals of the control signals 15–18 in accordance with the program stored in the ROM 19 from the CPU 12.

The loads such as the lamps buried in the operation keys are also controlled by the microcomputer through similar load control circuits.

The input signals from the sensors such as the original document size detection signal from the photo-detection circuit, the cassette size detection signal from the interface circuit 62 and the detection signals from the photo-interrupters Q1, Q2 and Q3 of the magnification/reduction mechanism are supplied to the I/O port 11 through the input bus 22 and supplied to the CPU 12 in synchronism with the control timing signals 15–18 and processed by the CPU 12 in accordance with the program stored in the ROM 19 to control the CPU 12.

Figure 13:
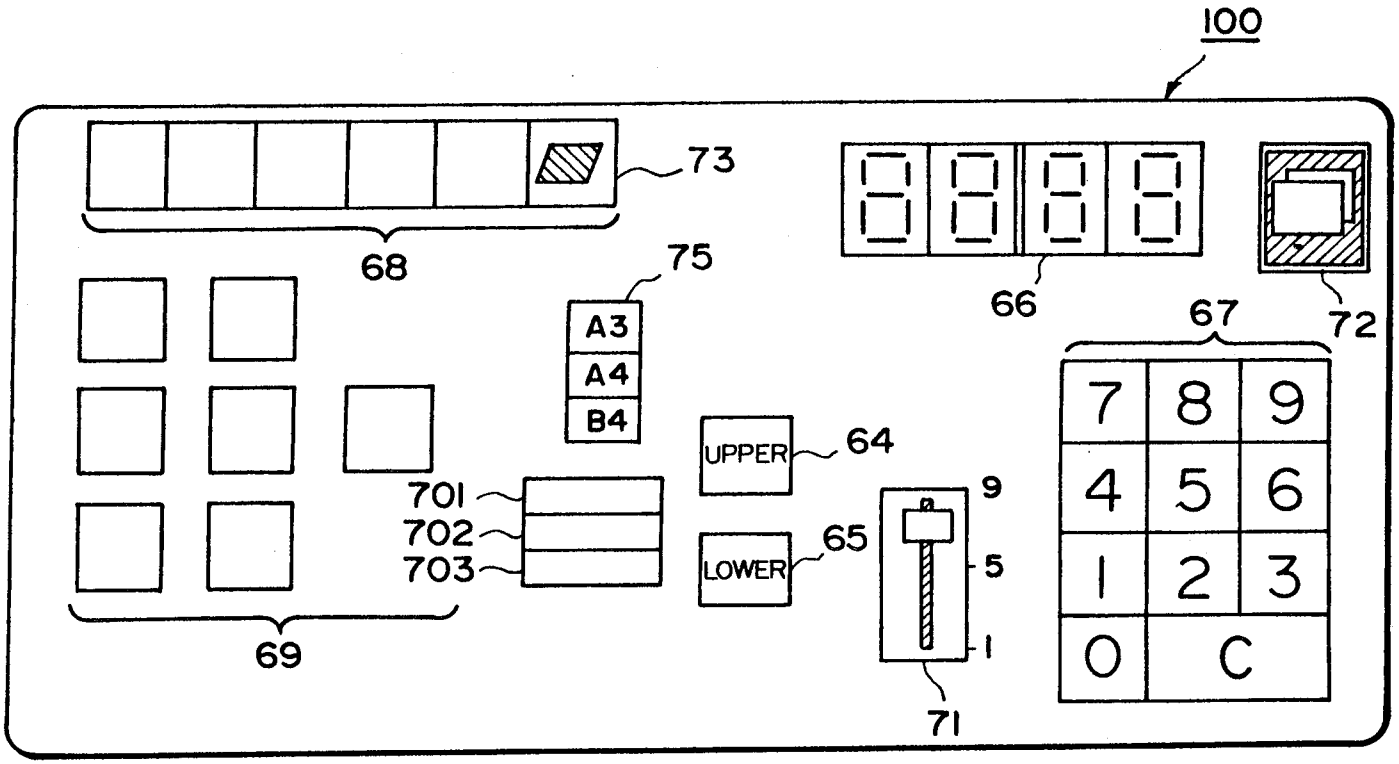
FIG. 13 shows a control panel.

The control panel 100 shown in FIG. 13 is now explained. Displays and the operation keys which are the input means for the operator are arranged on the control panel 100.

The operation keys include a copy start key 72, an upper cassette select key 64, a lower cassette select key 65, a ten-key 67, mode select keys 69 and a density setting key 71.

The copy start key 72 is an input key to start the copy operation, the upper cassette select key 64 and the lower cassette select key 65 are keys to select the upper and lower cassettes, respectively, as the paper feed cassette, and magnification/reduction scale select keys 701, 702 and 703 are keys to specify the magnification/reduction scales. They correspond to the reduction modes of A3→A4, A3→B4 and B4→A4, respectively.

The ten-key 67 includes keys to input the number of copies.

Figure 14:
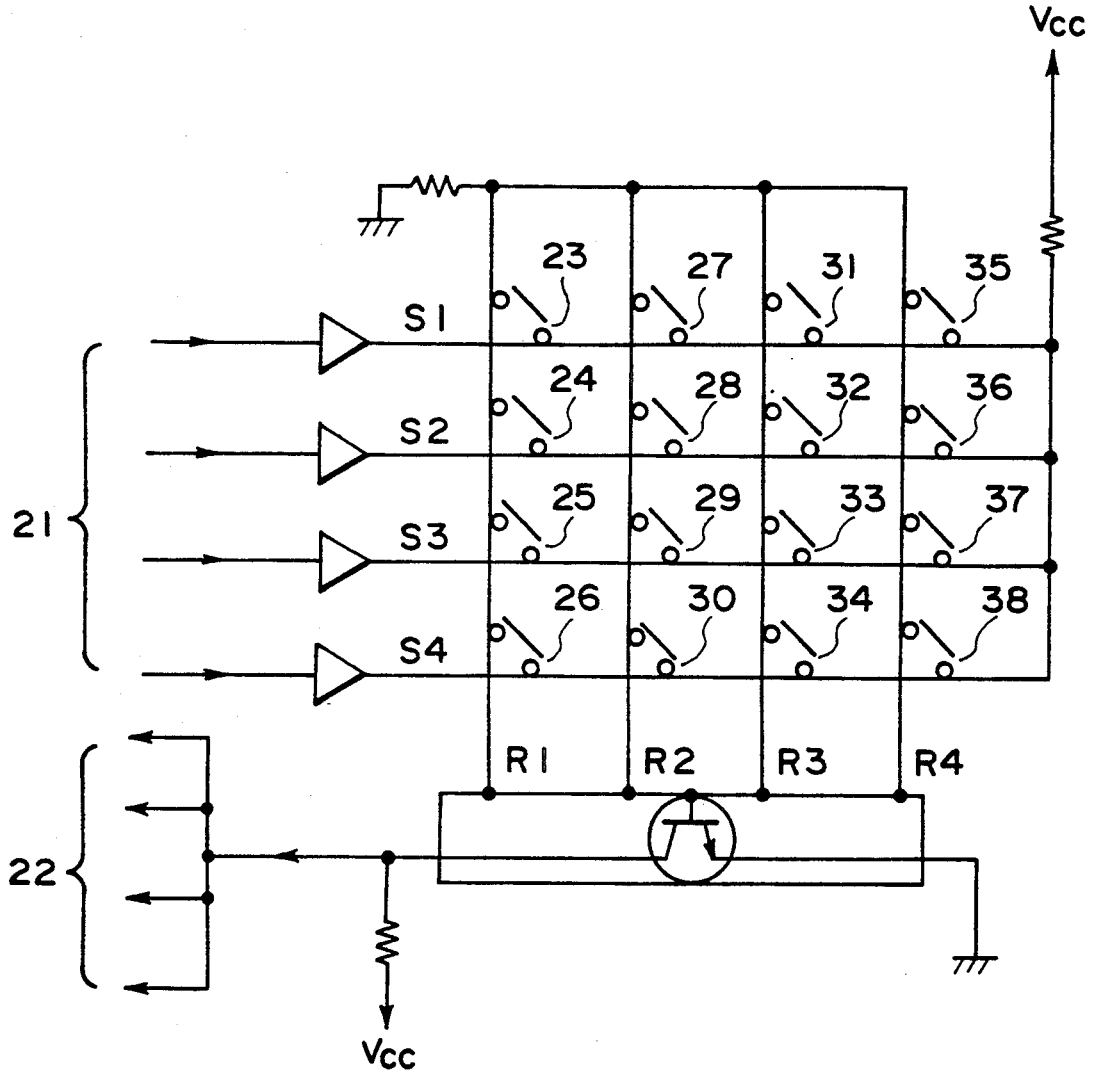
FIG. 14 shows a matrix circuit.

The operation keys are arranged on a matrix circuit having a number of contacts 23–38 shown in FIG. 14. When one of the keys is depressed by the operator, an input signal is supplied to the CPU 12 through the I/O port 11 and decoded thereby.

For example, when the copy start key (72 in FIG. 13) is depressed by the operator, the contact 23 is selected (assuming that the contact 23 corresponds to the copy start key), and signal outputted to scan lines S1–S4 of the matrix circuit from the I/O port 11 through the output bus 21 are supplied to return lines R1–R4 and supplied to the CPU 12 through the input bus 22 and the I/O port 11. The signals are decoded as the copy start signal by the CPU 12 so that the copy operation is started.

All operation keys except the ten-key 67 and the density setting key 71 are of self-illumination type, that is, have lamps buried therein which are controlled by the CPU 12 through the load control circuits as shown in FIG. 12. When one of the operation keys is depressed by the operator, the lamp associated with the depressed key is lit while the lamps of the other keys are extinguished.

Arranged on the control panel 100 are displays including 7-segment LED's 66 for indicating the number of copies, displays 68, a magnification/reduction mode display 700 and a cassette size display 75.

The displays 68 include a non-cassette display 73 which indicates the absence of the cassette when the cassette is selected in accordance with the original document size.

The cassette size display 75 displays the size of the loaded cassette selected by the depression of the upper cassette selection key 64 or the lower cassette selection key 65.

Figure 15:
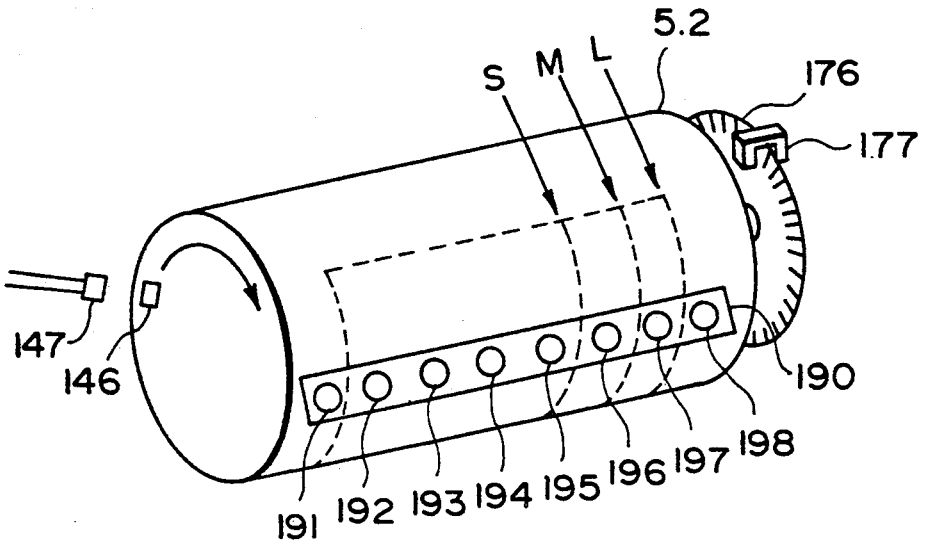
FIG. 15 shows a positional relationship between a discharge lamp array and a drum.

FIG. 15 shows a positional relationship of the discharging lamp array 190 to the photosensitive drum 52. As shown, the discharging lamp array 190 includes eight lamps 191–198 arranged in a line along the width of the photosensitive drum 52. The lamps 191–98 are individually turned on and off. When all of the lamps 191–198 are turned on, the charges on the photosensitive drum 52 are uniformly eliminated widthwise. $ Broken lines shown on the photosensitive drum 52 define image areas corresponding to the original document sizes, S being for the size A4 width, M being for the size B4 width and L being for the size A3 width. When only the lamps 191 and 198 are turned on, the charges on the area beyond the image width of the size A3 are eliminated. When the lamps 191, 197 and 198 are turned on, the charges in the area beyond the image width of the size B4 are eliminated. When the lamps 191, 196, 197 and 198 are turned on, the charges in the area beyond the image width of the size A4 are eliminated.

Figure 16:
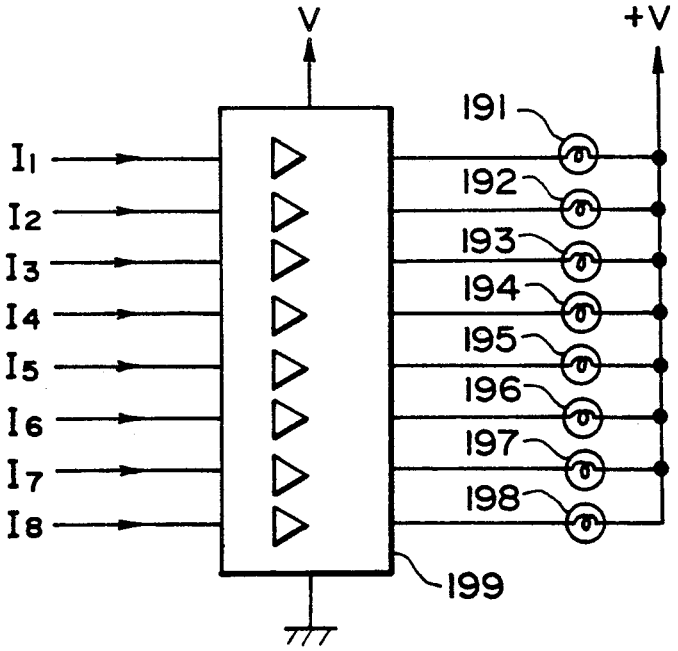
FIG. 16 shows a drive circuit for the discharge lamp array.

FIG. 16 shows a drive circuit for the discharging lamp array 190. Numeral 199 denotes a driver for individually driving the lamps 191–198. Turn-on control signals $I_1$–$I_8$ are supplied to the driver 199 through an I/O port to be described later to selectively turn on the lamps 191–198. When the turn-on control signal I is "0", the corresponding lamp is turned on, and when the signal I is "1", it is turned off. Thus, eight lamps 191–198 are selectively turned on by the 8-bit parallel input signals $I_1$–$I_8$. For example, when the signals $I_1I_8$ are "00001111", the lamps 191–194 are turned on and the lamps 195–198 are turned off. The charger 80 and the developing unit 200 may be split-driven without departing from the present invention.

Returning to FIG. 15, a magnet 146 is mounted at one end of the photosensitive drum 52. The position of the photosensitive drum 52 is detected by a Hall effect IC 147 which is activated by the magnet 146. The position at which the Hall effect IC 147 is activated by the magnet 146 corresponds to a home position of the photosensitive drum 52. A pulse emitting disc 176 is coaxially mounted to the photosensitive drum 52 and a photo-sensor 177 detects slots formed in the pulse emitting disk 177 to produce a clock pulse CP synchronized with the rotation of the photosensitive drum 52. The clock pulse CP is supplied to the microcomputer and counted thereby. The home position signal HP is also supplied to the microcomputer to reset the count to "0".

The operation of the present embodiment is now explained with reference to FIGS. 17, 18 and 19 and flow charts of FIGS. 20 and 21.

Figure 20:
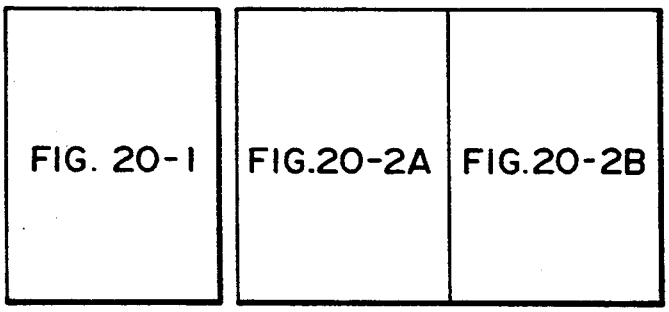
Figure 21A:
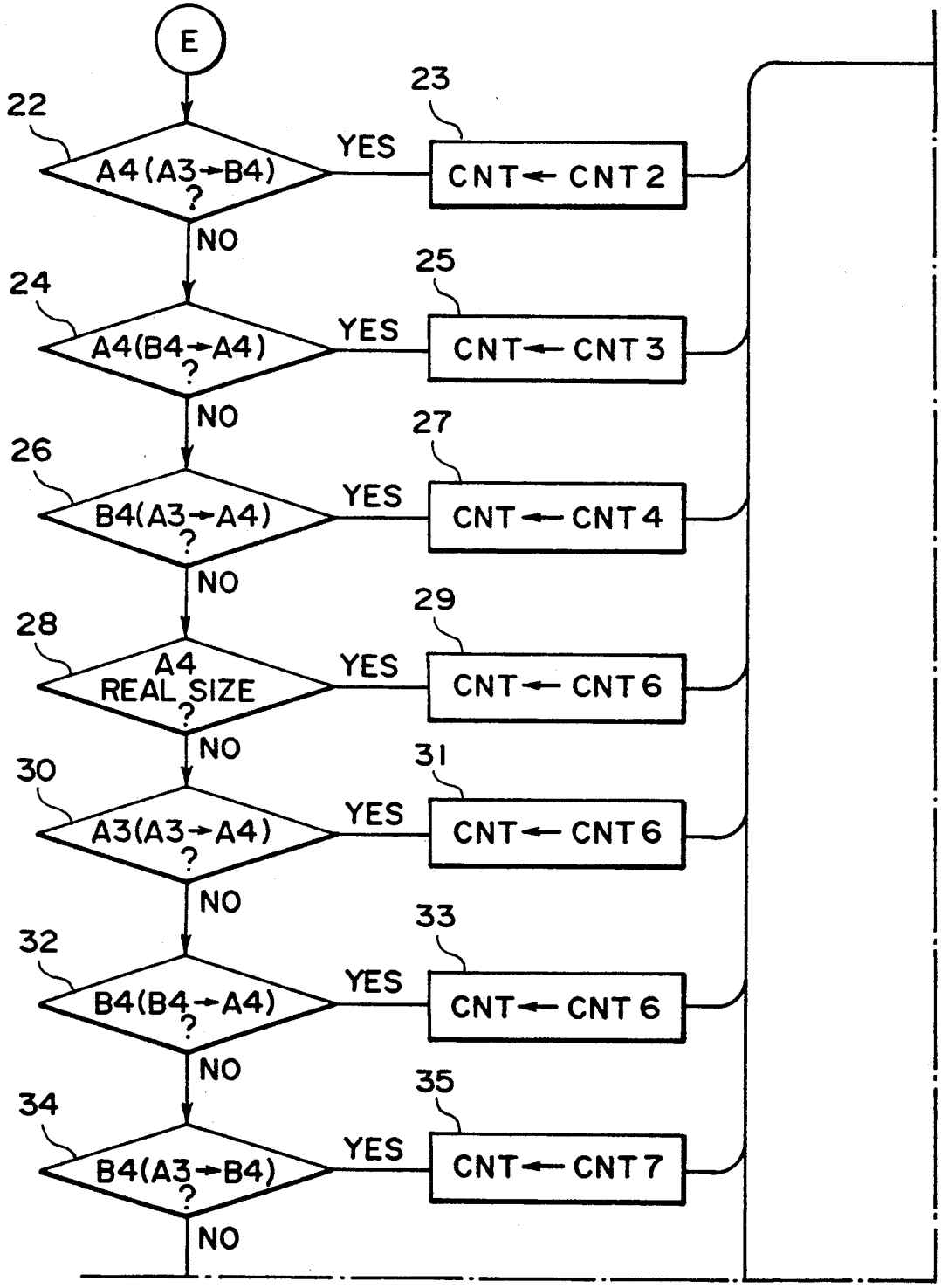
Figure 21B:
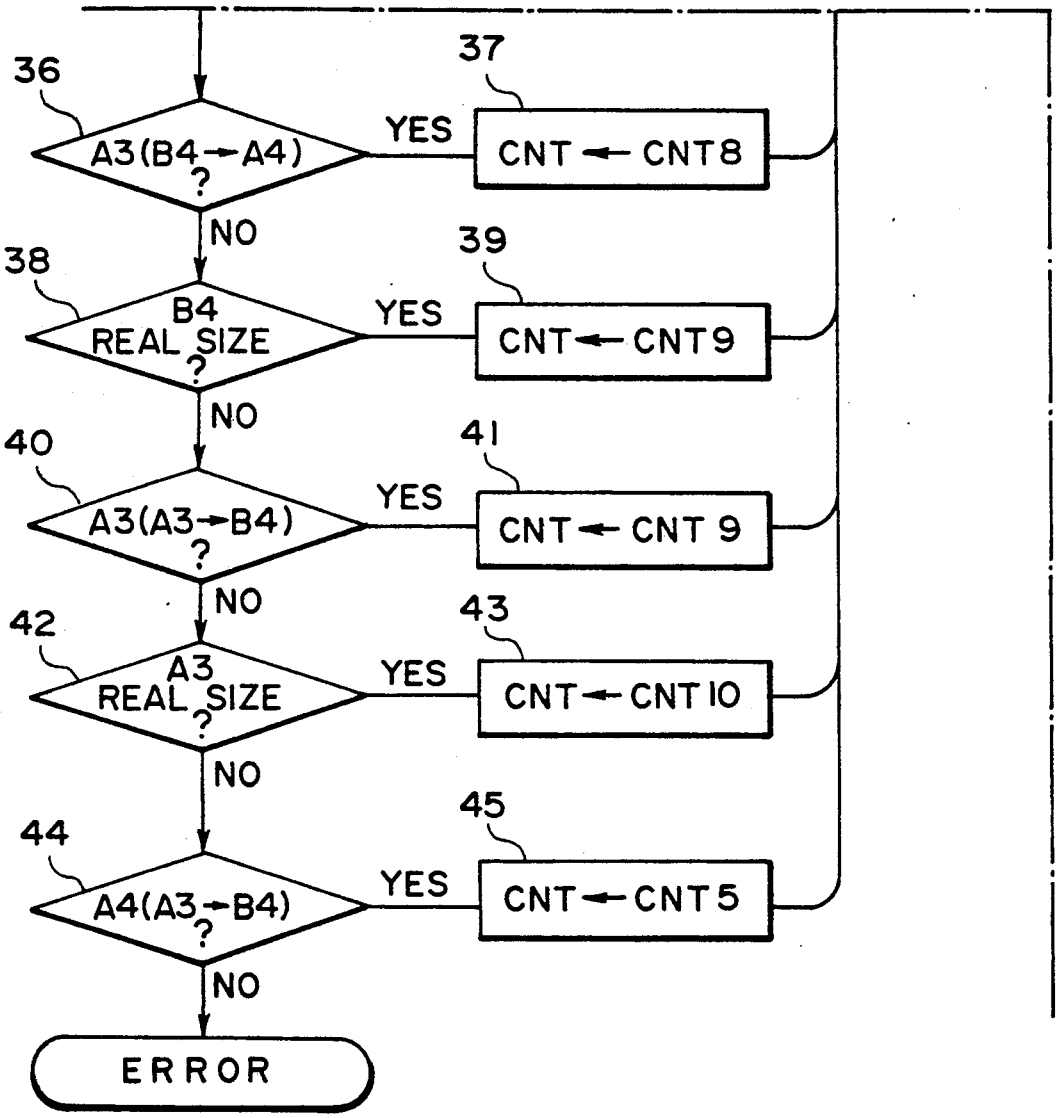
Figure 21C:
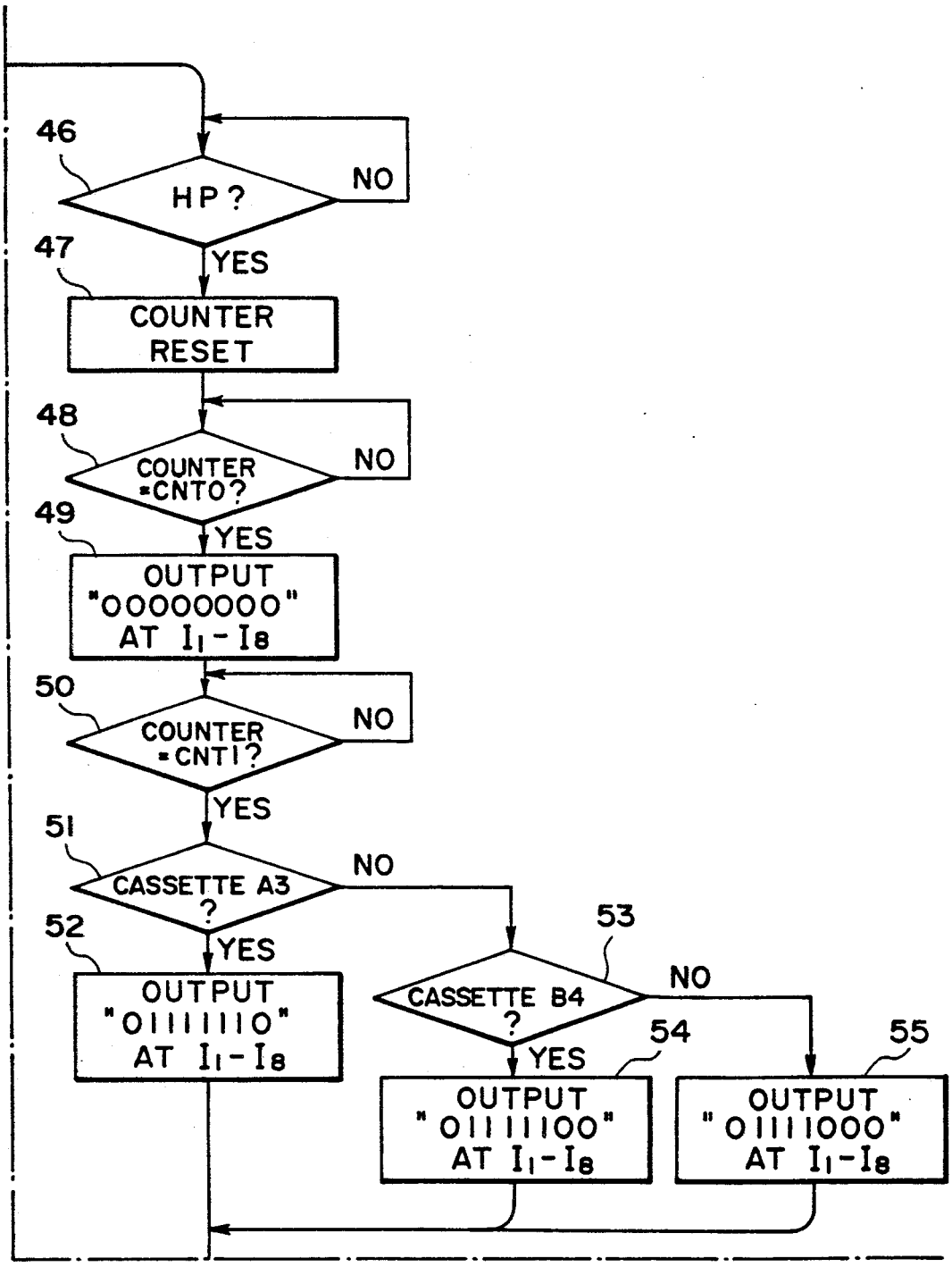
Figure 21D:
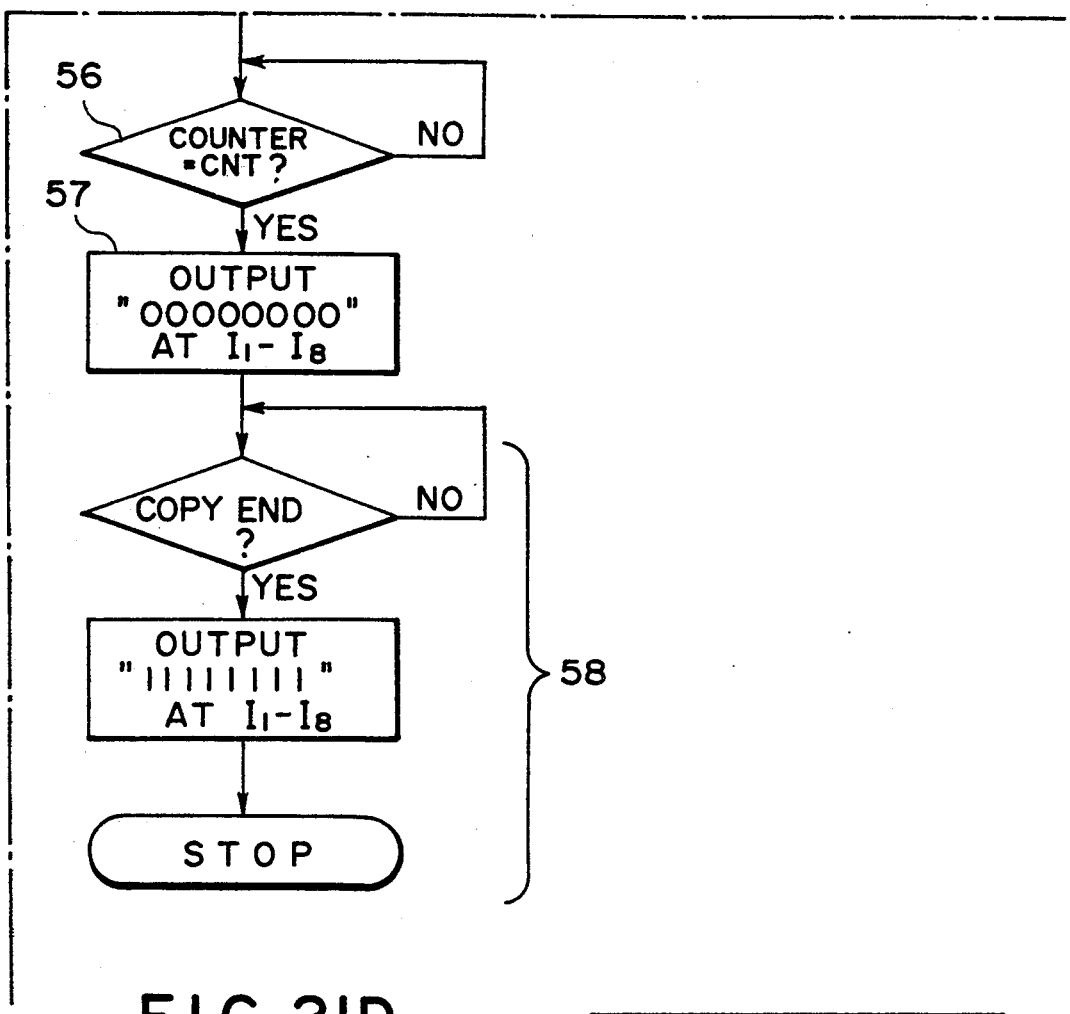
Figure 21:
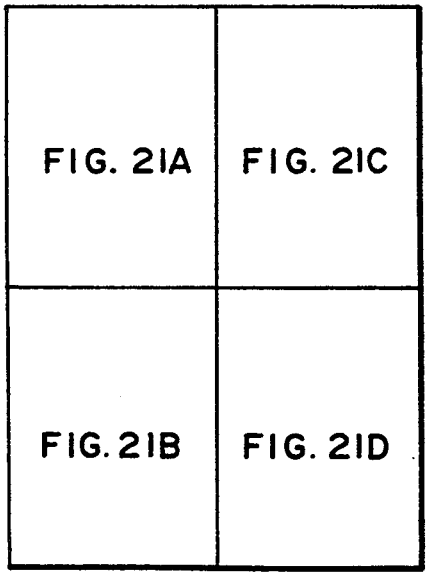

Referring to the flow chart of FIG. 20, in a step S1, a status of the copy start key is checked. If the copy start key is ON (YES), the CPU 12 proceeds to steps S2–S5.

In the steps S2–S5, the selected magnification/reduction mode (only the reduction mode is shown in the present embodiment although the magnification mode is similarly processed ) or unity scale is a discrimination mode, wherein the magnification/reduction optical system is moved and set in a step A, B, C or D. Since the steps A, B, C and D for the respective modes are the same, only the step A is explained. In steps 6–11, a magnification/reduction lock is released and a magnification/reduction motor is activated. When Q1 in FIG. 8 (unity scale position of the optical system) is detected, the magnification/reduction motor is deactivated and the reduction scale is locked. After the lens position of the magnification/reduction optical system has been determined, the size of the original document is detected (S12) in the sequence described above and the process proceeds to a step E.

After the CPU 12 has turned on the detection lamp, it advances the original document illumination scan table 10. As the scan table 10 is moved, the light from the detection lamp reaches the photo-sensors *7a*, *7b* and *7c* or is intercepted by the original document mounted on the platen glass. As a result, the photo-detection circuit produces the detection signal pattern as shown in FIG. 5 and it is supplied to the CPU 12, which decodes the original size.

Figures 17, 18:
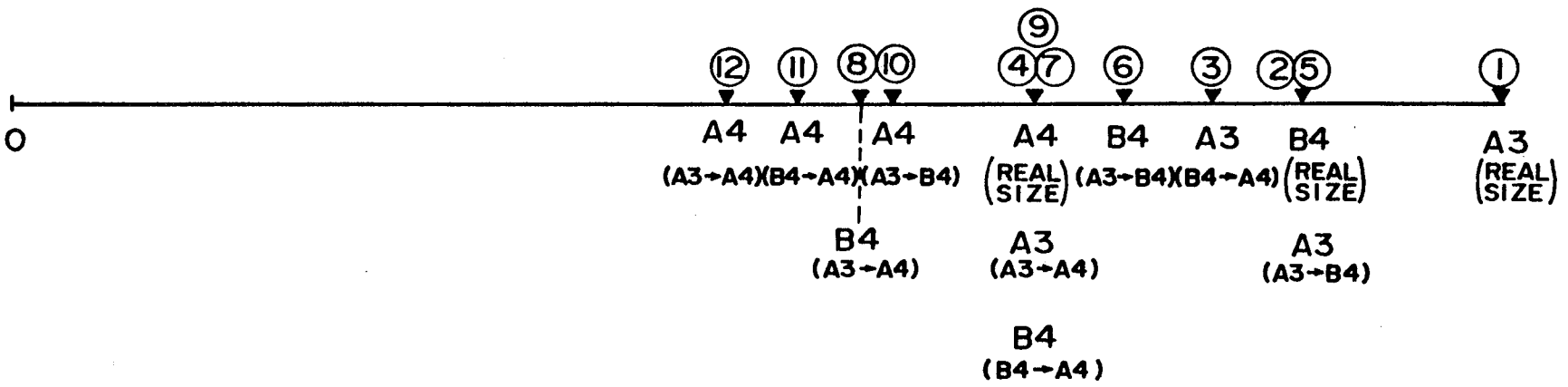
FIGS. 17 and 18 show image forming positions in respective modes.

As described above, prior to the copy sequence, an image is formed on the photosensitive drum in the direction of the original document feed as shown in FIG. 18 in accordance with the detected original document size and the selected reduction mode (A3→B4, B4→A4 or A3→A4) or the unity scale mode. For example, when the original document size is A3 and the A3→B4 reduction mode is selected, the original image is formed in accordance with 2 of FIG. 17, that is, between a point O and a point 2 in FIG. 18. It is the same area as that for the size B4—unity scale. When the original document size is B4 and the A3→A4 reduction mode is selected, the original image is formed at a position that is, between the point O and a point 8 in FIG. 18.

Figure 19:
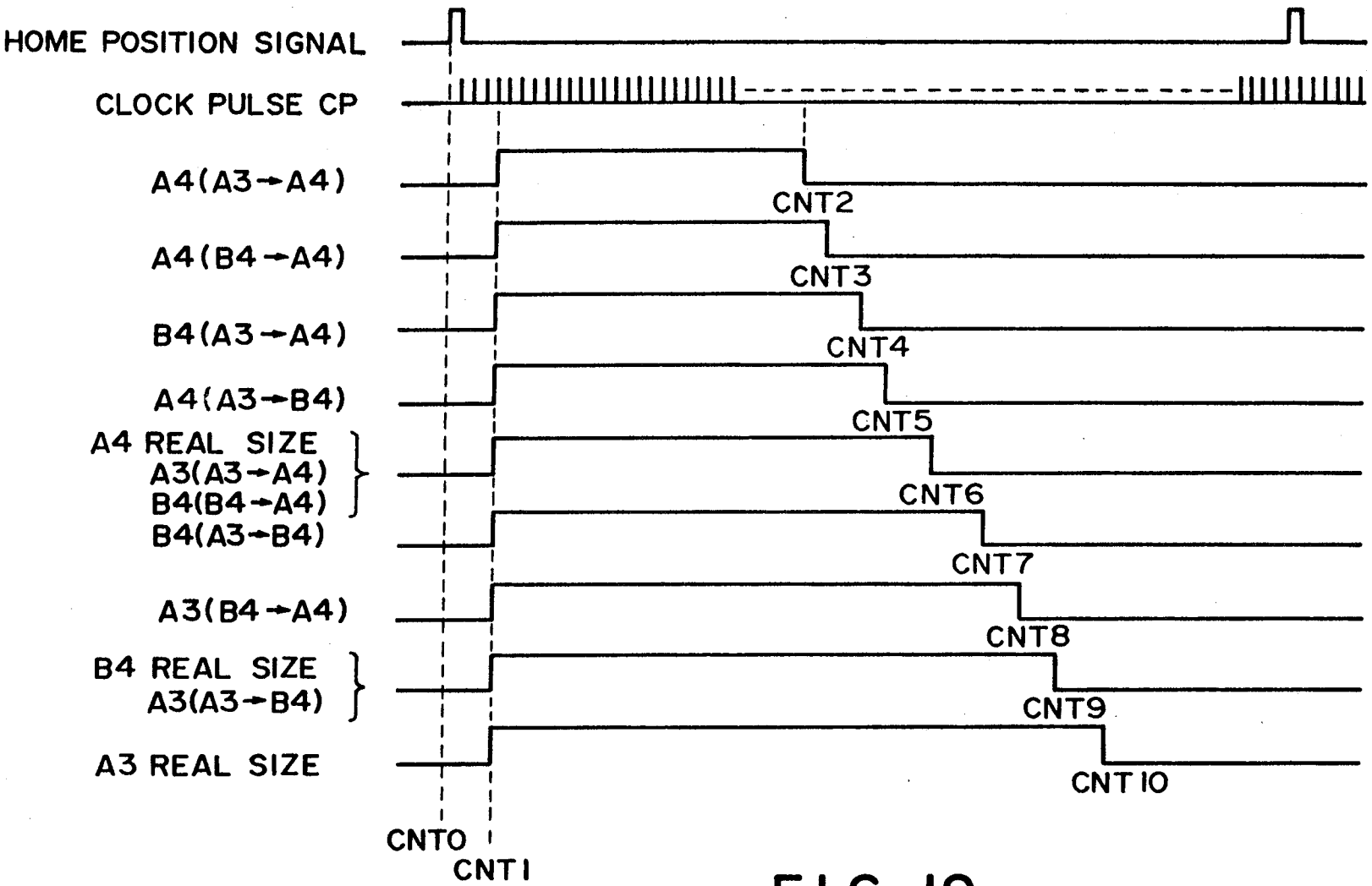
FIG. 19 shows a control time chart for one revolution of a photosensitive drum, FIG. 20 (comprising FIGS. 20-1, 20-2A and 20-2B), FIG. 21 (comprising FIGS. 21A, 21B, 21C and 21D), FIG. 23 (comprising FIGS. 23A, 23B, 23C and 23D), and FIG. 25 (comprising FIGS. 25, 25A and 25B) show flow charts for image forming area control, FIG. 22-A illustrates divided drive of the discharge lamp, FIG. 22-B shows an LED array turn-on circuit, FIG. 22-C shows a dynamic turn-on timing chart.

FIG. 19 shows a control time chart for one revolution of the photosensitive drum.

In FIG. 19, the home position on the photosensitive drum is detected by a sensor, not shown, and the home position signal is produced to indicate a start point of image formation. The microcomputer 12 starts to count the clock pulse CP from this time point. When the microcomputer 12 counts the clock pulse CP by a count CNT1 , it starts to selectively turn on the lamps 191–198 of the lamp array 190 shown in FIG. 15 in accordance with the size of the papers contained in the cassette in order to discharge the unnecessary widthwise area of the photosensitive drum. For example, when the papers in the cassette are of size A4, the lamps 196, 197 and 198 are turned on and when the papers are of size B4, the lamps 197 and 198 are turned on while the others are turned off. In order to discharge the area beyond the original image area formed in accordance with the original document size and the selected reduction mode or unity scale mode shown in FIG. 18, the lamp array 190 is selectively turned on for a period of counts CNT2–CNT10. For example, when the original document size is A4 and the A3→A4 reduction mode is selected, the lamp array 190 is selectively turned on at CNT1 and all lamps of the lamp array 190 are turned on at CNT4. Thus, only the unnecessary area beyond the original image area is discharged.

The above operation is explained with reference to the flow chart of FIG. 21. In steps 22–24, the selected reduction mode or unity scale mode and the original document size are determined, and a predetermined count is set. For example, if a decision at a step 36 is YES, it indicates that the original document size is A3 and the reduction mode is B4→A4. It corresponds to 3 in FIG. 17 and the image area is O to 3 in FIG. 18. In a step 37, a count CNT7 is set in the counter CNT as shown in FIG. 19. In a step 46, it is checked if the scanner is at the home position (HP), and if it is, the counter is reset in steps 47 and 48, and in a step 49 the turn-on control signals $I_1$–$I_8$ shown in FIG. 16 are set to all 0's so that all lamps are turned on. In a step 50, the counter CNT counts the clock pulse (CP) to the count CNT1, and in step 51 and 53 the cassette size is detected. If the cassette size is A4, the process proceeds to a step 55. If the cassette size is A3, the signals $I_1$–$I_8$ are set to "01111110" in a step 52 to discharge the widthwise unnecessary area on the photosensitive drum. When the count reaches CNT8 in a step 56, the signals $I_1$–$I_8$ are set to "00000000" in a step 57 to turn on all of the lamps in order to discharge the unnecessary area along the original document feed direction. If the copy operation is completed, the lamps are turned off and the operation is stopped (step 58).

In addition to the discharging lamp control described above, the developing unit and the charger may be split-driven to control the image formation area. By arranging a number of original document size detection means, the image formation area can be controlled even for an original document of a post card size. Instead of the magnification/reduction of fixed scale, a continuous scale magnification/reduction by a zooming mechanism may be used.

Figure 22A:
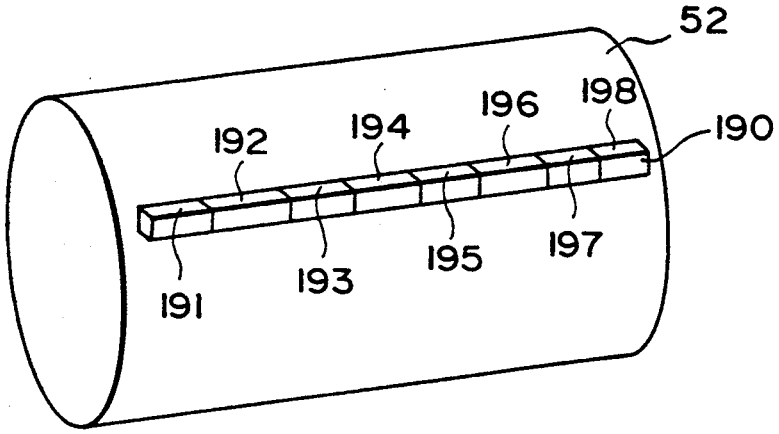
Figure 22C:
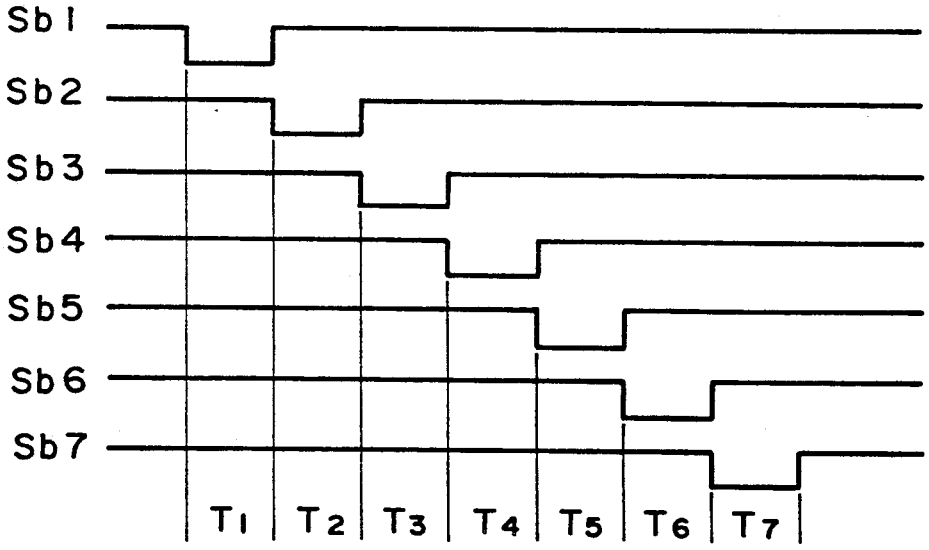
Figure 22B:
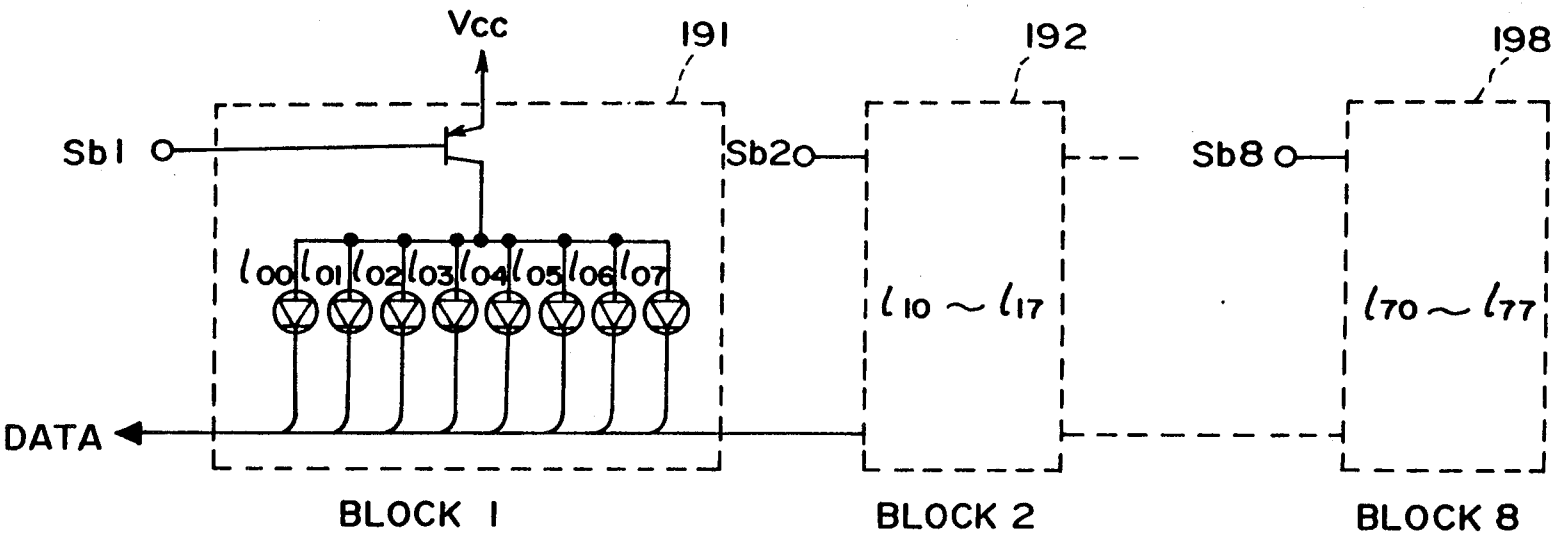
Figure 23A:
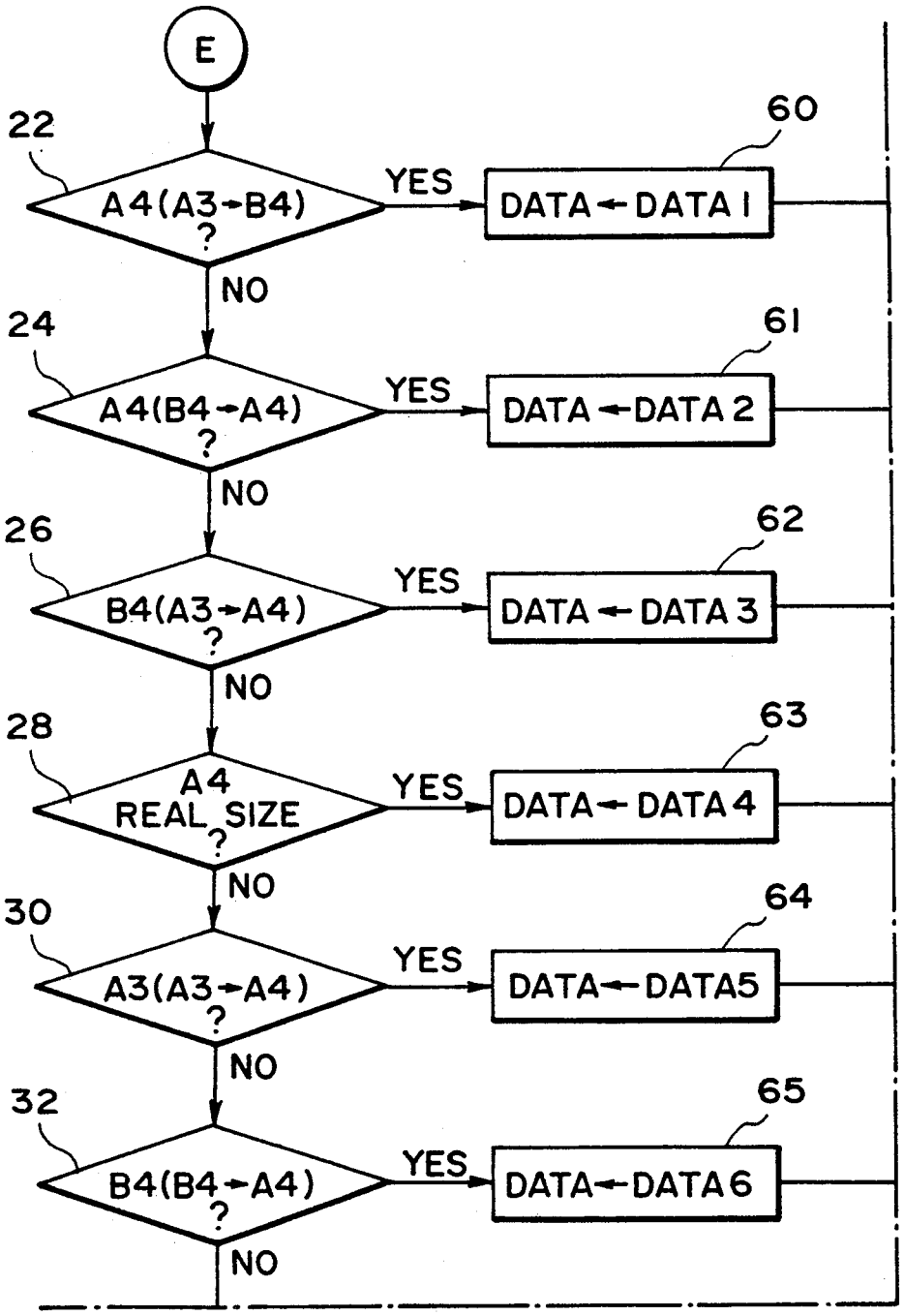
Figure 23B:
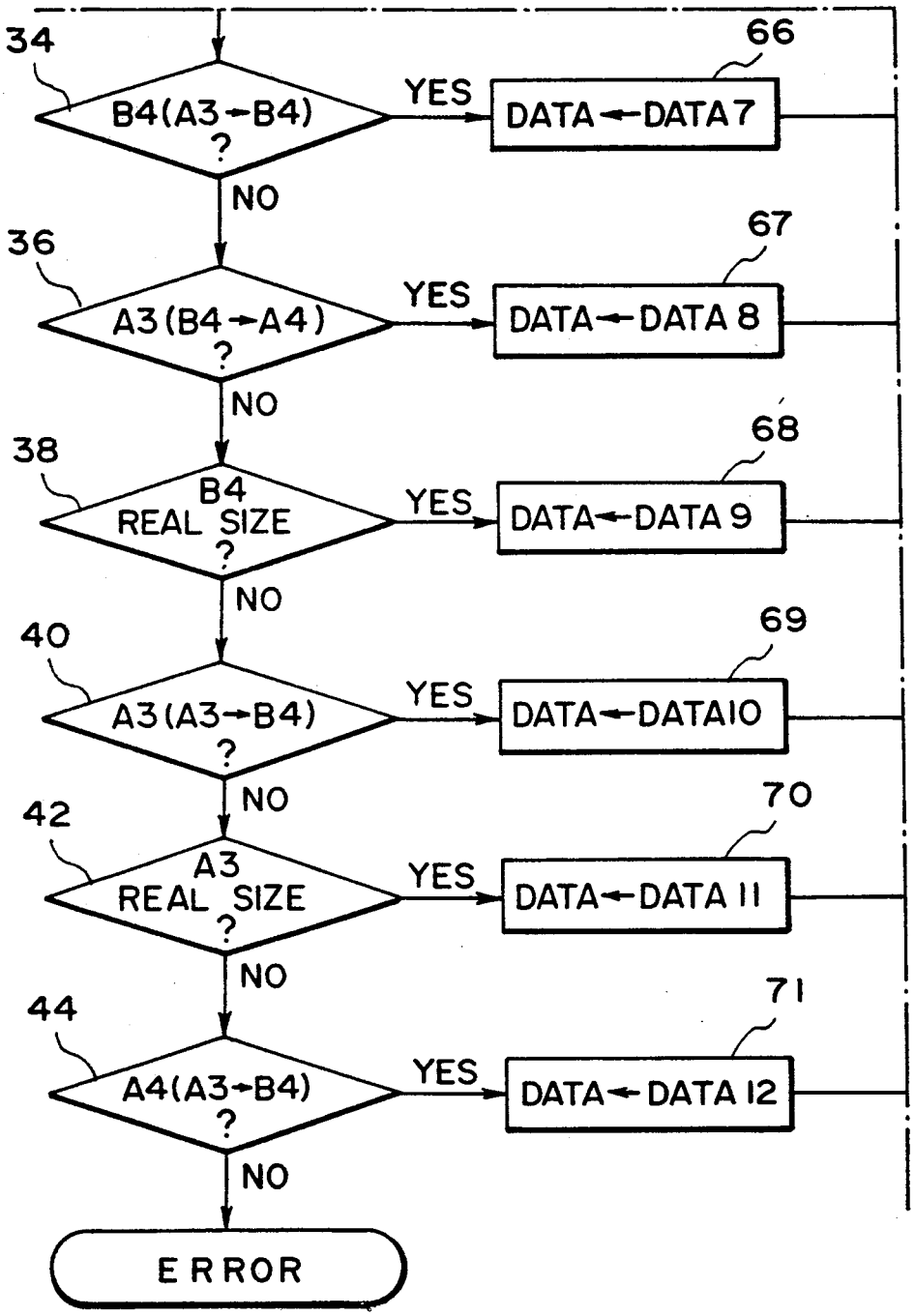
Figure 23C:
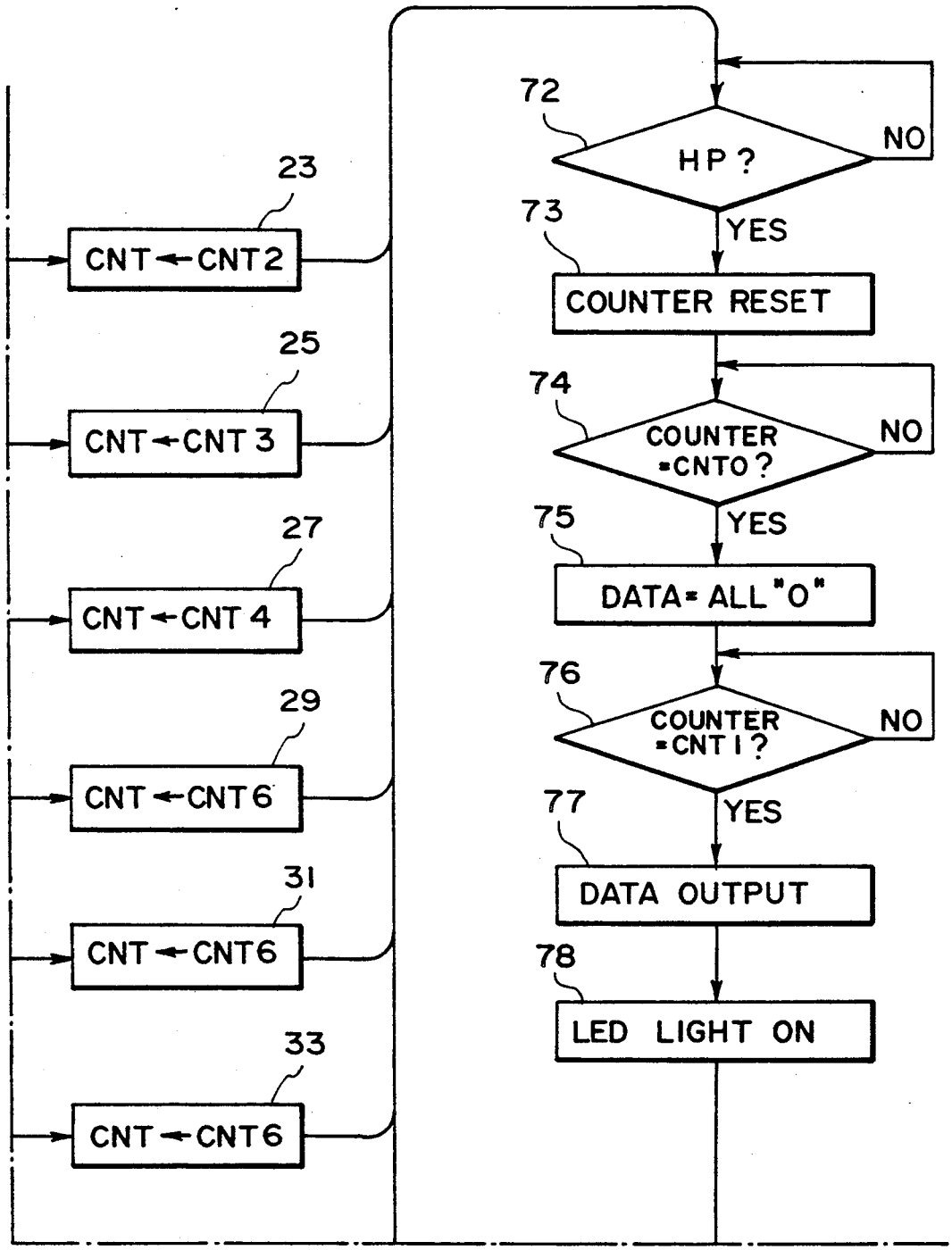
Figure 23D:
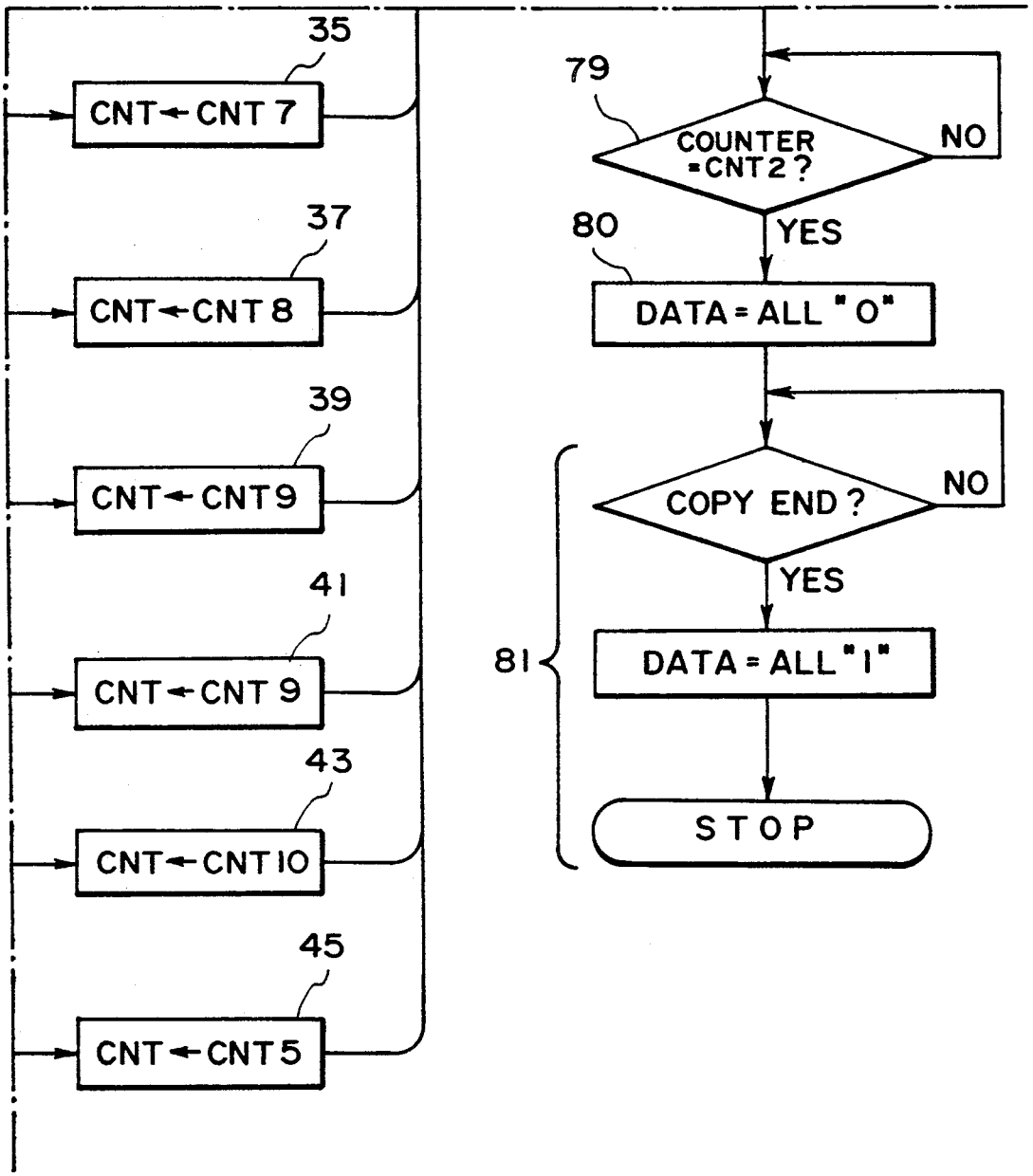

The control to the widthwise image formation area on the drum is now explained in further detail. FIG. 22-A through 22-C shows a method for controlling the image formation area by split-driving the discharging lamp. FIG. 22-A shows a positional relationship between the drum 52 and the discharging lamp array 190. The discharging lamp array 190 is an LED array having LED blocks 191–198. FIG. 22-B shows an LED array turn-on circuit. When a block select signal Sbn in DATA is "0"and a bit signal Inm in the block is "0", the corresponding LED is turned on, and when it is "1", the LED is turned off. FIG. 22-C shows a dynamic turn-on timing chart. An 8-bit turn-on signal for a block n is produced in a period Tn.

Figure 23:
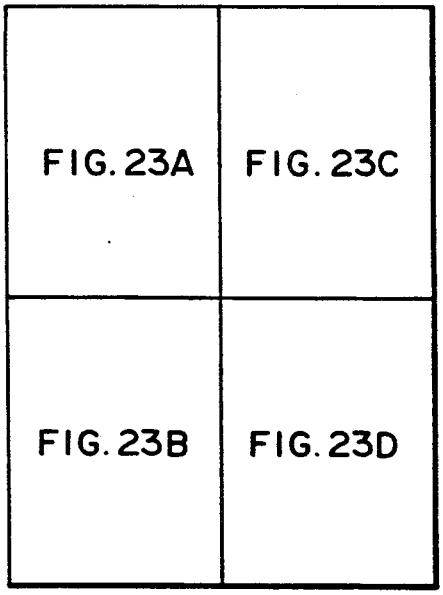
Figures 1, 20:
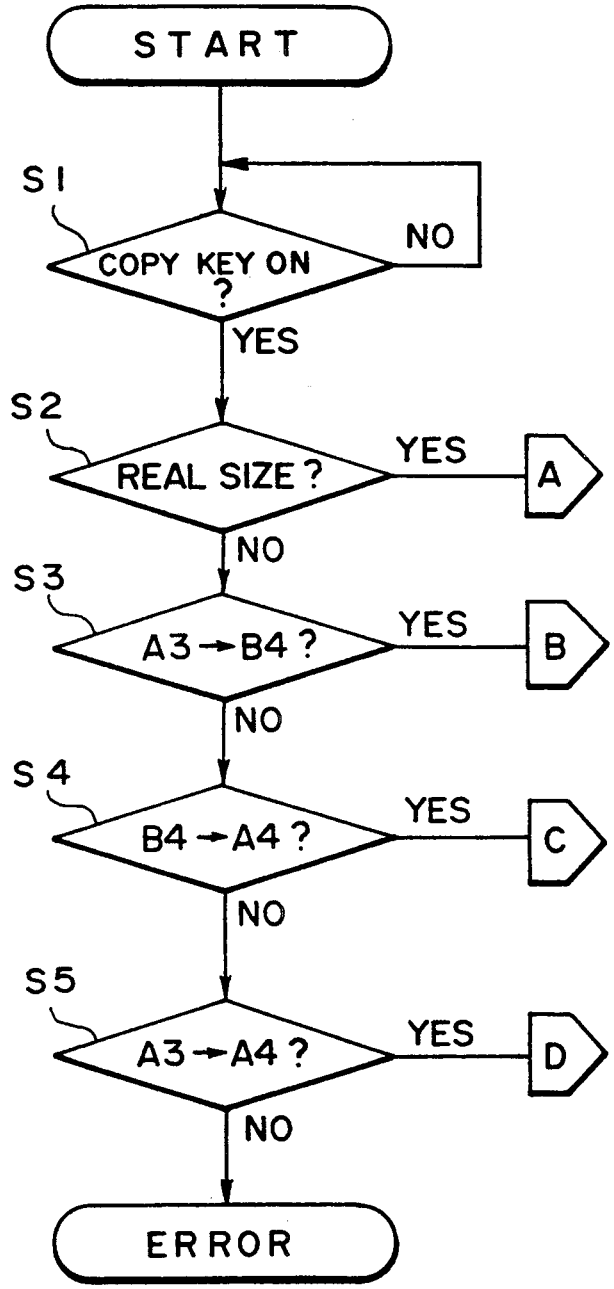
Figures 2A, 20:
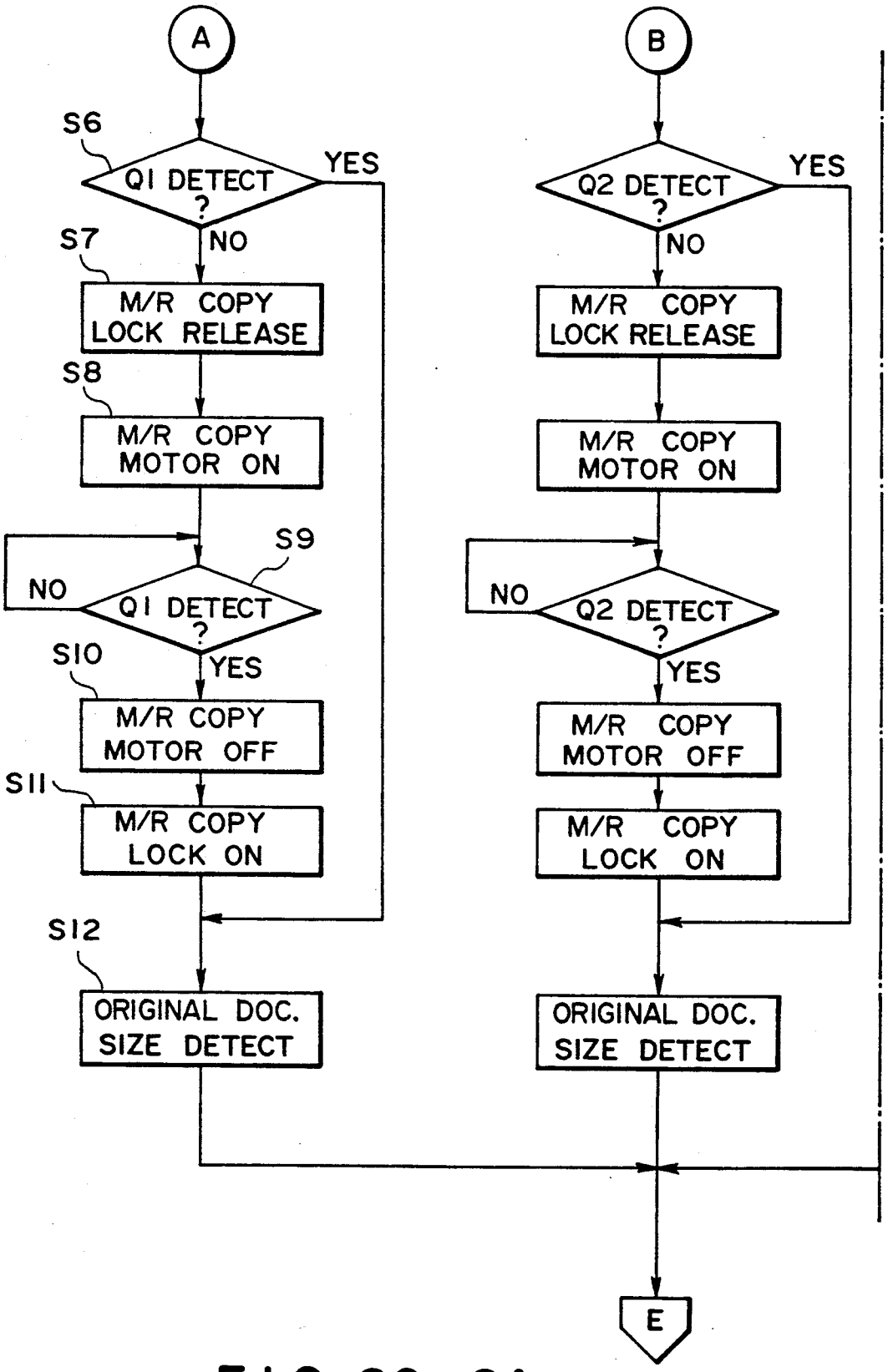
Figures 2B, 20:
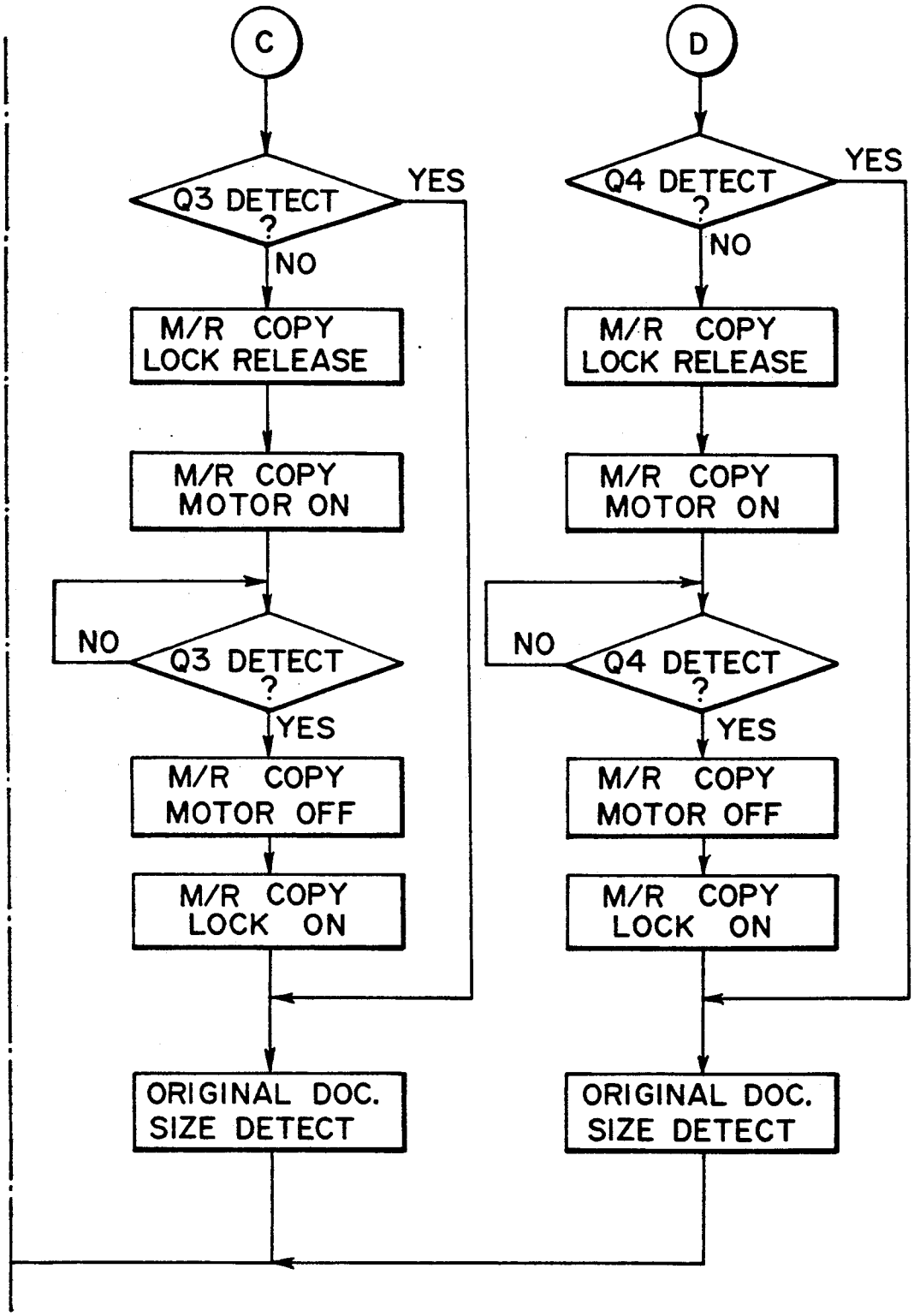

The control sequence for the above operation is shown in FIG. 23. It shows a flow chart for controlling the discharging lamps in the width direction of the drum and the original document feed direction in accordance with the image formation area. Steps 22–45 are same as those in FIG. 21. In steps 60–71, the copy size is determined based on the original document size and the selected reduction mode and a data for selectively turn on the LED's is set to the DATA bits. Each data consists of eight bytes and the LED array consists of 64 LED's. In a step 72, if the scanner is at the home position, the counter is reset in steps 73 and 74, and in a step 75 the data bits for driving the LED's are all set to "0" to turn on all LED's. In a step 76, if the count is CNT1 (FIG. 19), the data is outputted in steps 77 and 78 to selectively turn on the LED's in order to discharge the widthwise unnecessary area beyond the image formation area.

When the count reaches CNTn in a step 79, all LED's are turned on (DATA=all-"0's") to affect blank exposure (STEP 80). In a step 81, if the copy operation is completed, the DATA is set to all-"1's" to turn off the LED's.

Figure 24:
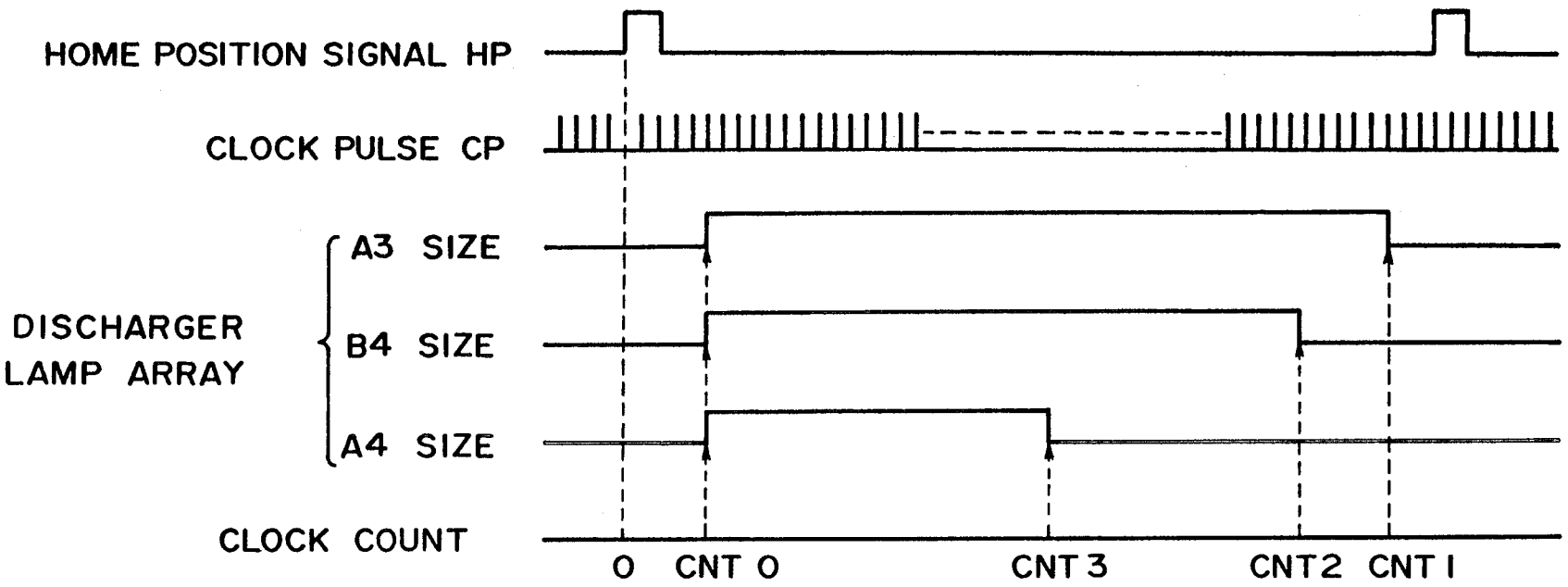
FIG. 24 shows a control time chart.
Figures 25, 25A:
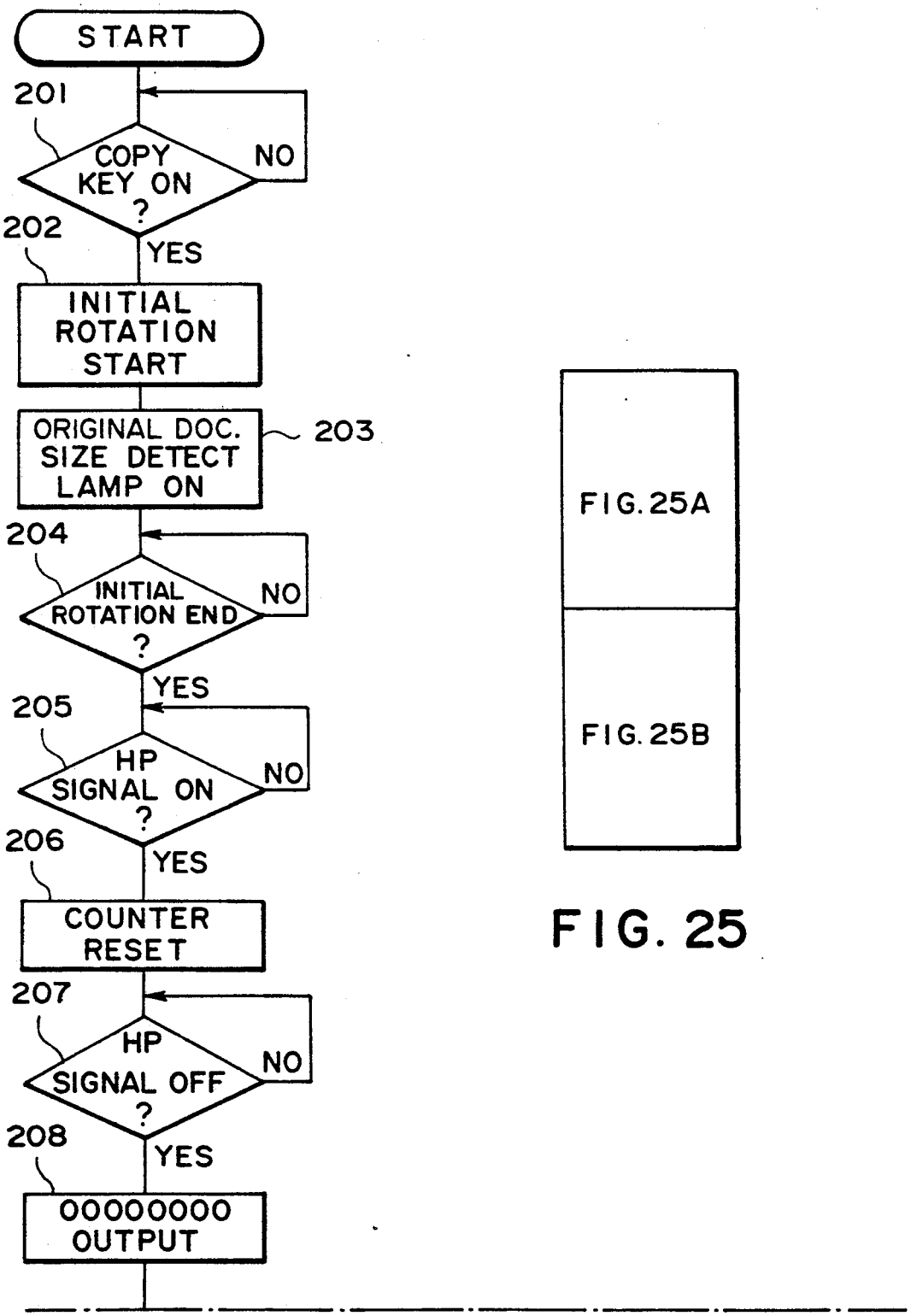
Figure 25B:
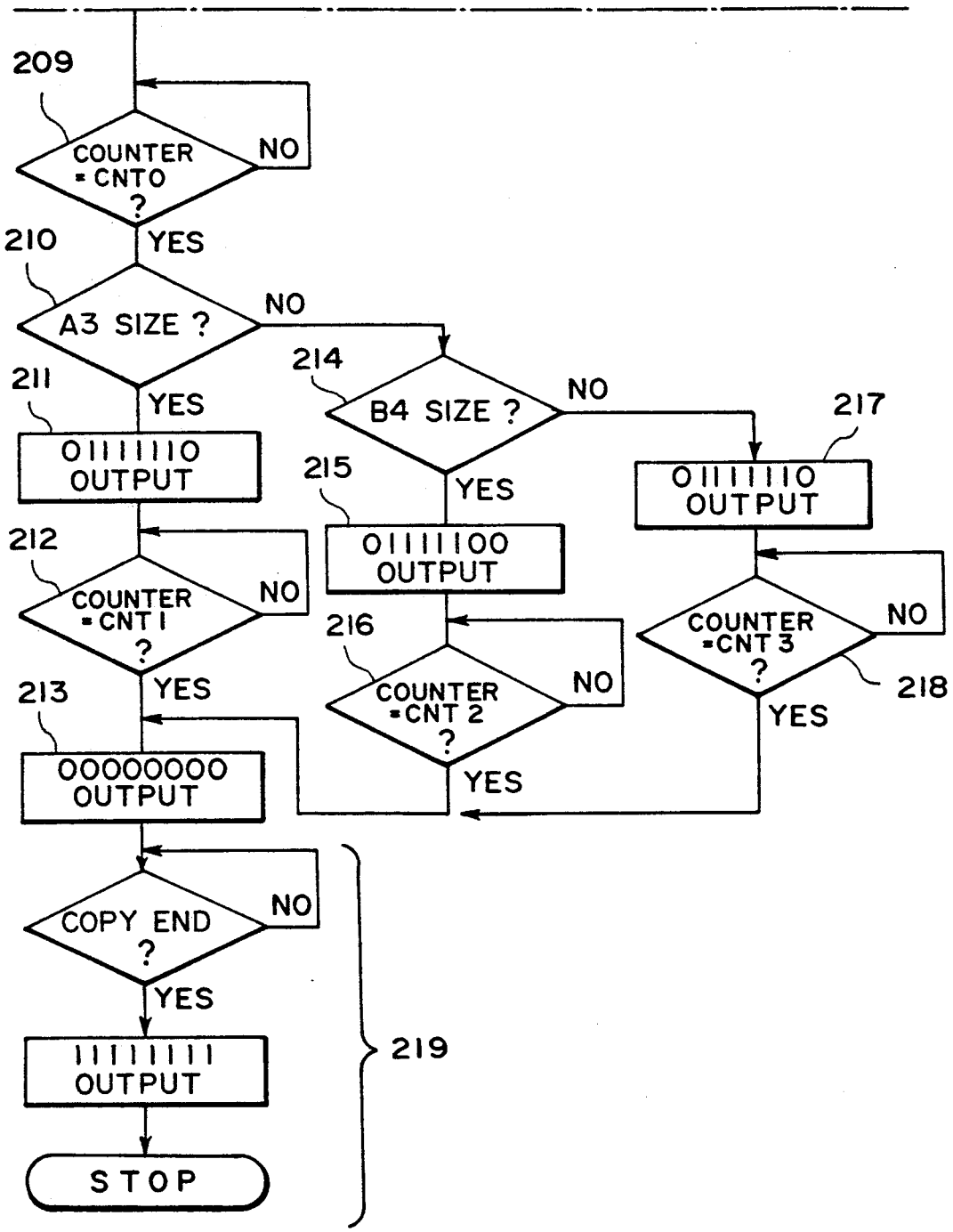

The operation of the image forming apparatus having only the unity scale mechanism will now be explained with reference to FIG. 15, a time chart of FIG. 24 and a control flow chart of FIG. 25. In a step 205, the signal HP is turned on, in a step 206, the counter is reset, and in a step 207 the signal HP is turned off. In a step 208, all lamps of the discharging lamp array 190 are turned on. In steps 210 and 214, the original document size is checked, and if it is size A3, for example, "01111110" is outputted in a step 211 to discharge widthwise. In a step 212, the count is checked and if it is equal to CNT1, all of the lamps are turned on to discharge in the document feed direction, and if the copy operation is completed in a step 219, the lamps are turned off and the operation is stopped. In steps 212, 216 and 218, the counts CNT3, CNT2 and CNT1 indicating the length of the original document are counted. In this manner, the image is not formed in the area other than the desired image formation area, a clean copy is produced, and waste of the developing agent is prevented.

In FIGS. 2 and 3, the reflection type photosensors may be the photosensor 7*a*, and photosensors 7*b*' and 7*c*' shown by broken lines in FIG. 3, instead of the photosensors 7*b* and 7*c* for detecting the width of the original document. The sensor 7*a* for the small size document may be commonly used to detect the width and the length. The length of the document may be determined by comparing the sense time of the sensor with the timer count. Automatic magnification/reduction may be attained based on the original document size and the information from the cassette size detection means of FIG. 6. A reflection type or transmission type sensor may be arranged closely to the original document feed mechanism so that the original document size is detected while it is fed.

What is claimed is:

1. An image forming apparatus comprising:

a platen adapted for putting thereon an original document;

means for illuminating the original document put on said platen;

a photosensitive medium;

charging means for applying electric charge on said photosensitive medium;

means for setting a desired magnification;

means for forming a latent image corresponding to the illuminated original document on the charged photosensitive medium wherein said latent image is formed at the desired magnification set by said setting means;

means for removing charge from a portion of said photosensitive medium, said removing means comprising a plurality of light sources each individually operable;

developing means for providing a visible image for the latent image formed on said photosensitive medium;

means for transferring the visible image on said photosensitive medium to a recording sheet;

a plurality of sensing means each for sensing whether the original document is absent at associated ones of a plurality of predetermined positions on said platen;

means for detecting a size of the original document prior to the latent image forming operation by said forming means, said detecting means designating the original document to corresponding to one of a plurality of fixed sizes based on respective outputs of said plurality of sensing means;

means for determining light sources to be turned on and light sources to be turned off among said plurality of light sources, and for determining a period of time for the light sources to be turned off on the basis of the combination of the magnification set by said setting means and the size detected by said detecting means; and means for controlling, during the latent image forming operation of said forming means, the operation of said plurality of light sources in accordance with a determination result of said determining means to that charge can be removed from an area on said photosensitive medium other than the area of the latent image corresponding to the original document.

2. An image forming apparatus according to claim 1, wherein said forming means is arranged to form the latent image on said photosensitive medium based on a light image from the original document placed on said platen.

3. An image forming apparatus according to claim 2, wherein said forming means includes an optical member for focusing the light image from the original document on said photosensitive medium, and means for driving said optical member in accordance with the desired magnification.

4. An image forming apparatus according to claim 1, wherein each of said sensing means includes a light source for exposing the original document and a photo-receiving means for receiving light from said light source, and said detecting means is arranged to detect the size of the original document based on an output of said photo-receiving means.

5. An image forming apparatus according to claim 1, wherein said forming means is adapted to form the latent image in a plurality of mutually different magnifications, and said setting means sets a desired one of said plurality of different magnifications.

6. An image forming apparatus according to claim 1, wherein said removing means comprises a plurality of LEDs illuminating said photosensitive medium.

7. An image forming apparatus according to claim 1, wherein said photosensitive medium has a rotatable drum configuration.

8. An image forming apparatus according to claim 1, further comprising generating means for generating timing pulses synchronized with movement of said photosensitive medium and said controlling means controls the operation of said plurality of light sources bases on the timing pulses.

* * * * *

UNITED STATES PATENT AND TRADEMARK OFFICE

CERTIFICATE OF CORRECTION

PATENT NO. : 5,072,259

DATED : December 10, 1991

INVENTOR(S) : Ikeda Yoshinori

It is certified that error appears in the above-identified patent and that said Letters Patent is hereby corrected as shown below:

COLUMN 1

Line 62, "other" should read --another--.

COLUMN 2

Line 55, "drum 52 is" should read --drum (or medium) 52 is--.
Line 58, "or medium" should be deleted.

COLUMN 4

Line 4, "signals FIG." should read --signals. FIG.--.
Line 66, "lens 7" should read --lens 70--.

COLUMN 5

Line 31, "of" should be deleted.

COLUMN 7

Line 2, "display 700" should read --display 100--.
Line 15, "lamps 191-98" should read --lamps 191-198--.
Line 18, "$" should be deleted.
Line 40, "signals $I_1I_8$" should read --signals $I_1$-$I_8$--.
Line 54, "177" should read --176--.
Line 68, "scale is" should read --scale mode is--.

UNITED STATES PATENT AND TRADEMARK OFFICE

CERTIFICATE OF CORRECTION

PATENT NO. : 5,072,259

DATED : December 10, 1991

INVENTOR(S) : Ikeda Yoshinori

It is certified that error appears in the above-identified patent and that said Letters Patent is hereby corrected as shown below:

COLUMN 8

Line 4, "steps 6-11" should read --steps S6-S11--.
Line 31, "2" should read --2--.
Line 32, "point 2" should read --point 2--.
Line 35, "position that" should read --position 8, that--.
Line 36, "point 8" should read --point 8--.

COLUMN 9

Line 3, "3" should read --3-- (both occurrences).

COLUMN 11

Line 13, "to" should read --so--.

UNITED STATES PATENT AND TRADEMARK OFFICE

CERTIFICATE OF CORRECTION

PATENT NO. : 5,072,259

DATED : December 10, 1991

INVENTOR(S) : Ikeda Yoshinori

It is certified that error appears in the above-identified patent and that said Letters Patent is hereby corrected as shown below:

Column 12, line 25, "bases" should read --based--.

Signed and Sealed this

Eighteenth Day of May, 1993

*Attest:*

Michael K. Kirk

MICHAEL K. KIRK

*Attesting Officer*

*Acting Commissioner of Patents and Trademarks*